US005711138A

United States Patent [19]

Yamamoto

[11] Patent Number: 5,711,138

[45] Date of Patent: Jan. 27, 1998

[54] PACKING ASSIST APPARATUS

[75] Inventor: Kohei Yamamoto, Fukuoka, Japan

[73] Assignee: Fukuoka Marumoto Co., Ltd., Fukuoka, Japan

[21] Appl. No.: 666,821

[22] Filed: Jun. 19, 1996

[30] Foreign Application Priority Data

Jun. 20, 1995 [JP] Japan ..... 7-178060
Dec. 28, 1995 [JP] Japan ..... 7-353707

[51] Int. Cl.[6] ..... B65B 43/36; B65B 67/04; B65B 43/12

[52] U.S. Cl. ..... 53/571; 53/573; 53/385.1; 53/390

[58] Field of Search ..... 53/571, 573, 570, 53/390, 459, 469

[56] References Cited

U.S. PATENT DOCUMENTS 3,431,706 3/1969 Stuck ..... 53/390
3,961,461 6/1976 Ruf et al. ..... 53/571
4,242,854 1/1981 Nissen ..... 53/573 X
4,572,251 2/1986 Drury ..... 53/390 X
4,696,146 9/1987 Esch et al. ..... 53/570 X
5,511,364 4/1996 Levi et al. ..... 53/573 X

*Primary Examiner*—Horace M. Culver
*Attorney, Agent, or Firm*—Birch, Stewart, Kolasch & Birch, LLP

[57] ABSTRACT

A packing assist apparatus is provided which assures that articles to be packed can continuously be packed without close contact of the surface of a packing film with the surface of the articles and each packing operation can be performed at improved efficiency. A rotary member is disposed on a support column standing upright from a base board, an arm is fitted to the rotary member, and a holding frame having an opening portion through which the articles can pass is fitted to the arm. Putting means for putting a packing bag on the holding frame is arranged below the rotary member.

28 Claims, 14 Drawing Sheets

PACKING ASSIST APPARATUS

BACKGROUND OF THE INVENTION

1. Field of the Invention

The present invention relates to a packing assist apparatus usable when vegetables, fruits or flowers such as egg-apple, cucumber or the like (hereinafter referred to as articles) packed in a packing bag.

Many articles are sold in a supermarket or the like while a suitable number of them are packed in a bag of synthetic resin film such as polyethylene or the like. Packing is normally performed during the course when they are collected from producers and delivered to supermarket or the like.

2. Description of the Background Art

Generally, the articles are packed in such a manner that, for example, about three to five egg-apples or cucumbers or the like, about three to six pimentos, potatoes, onions or the like or about three to four apples, persimmons or the like are received in a bag of synthetic resin film and the upper part of the bag is closed by binding with an adhesive tape or thermal fusing.

The articles are packed in facilities owned by a local agricultural organization or the like. In facilities where a large number of articles are handled, they are packed by operating an automatic packing machine, whereas in facilities where a small number of articles are handled, they are manually packed with operators' hands.

In the case that articles are manually packed, an efficiency of packing operation remarkably varies depending on the kind of articles, i.e., vegetables or fruits. For example, in the case that articles each having a smooth surface, e.g., egg-apples, pimentos, apples, persimmons or the like are packed, when they are collectively packed in a packing bag, it is difficult for them to slidingly proceed to the bottom of the packing bag due to the fact that their surfaces are adhesive to the inner surface of the synthetic resin film. Thus, when they are put in the bag one by one, their adhesive contact state is attenuated but the packing efficiency is remarkably degraded.

In the case of egg-apples, their surfaces are liable to adhere to each other due to their whole configuration and elasticity when second or third egg-apple are put in the same bag. Thus, there readily arises an occasion wherein an egg-apple to be put in the bag later can not move back and forth not only due to its close contact with the surface of the bag film but also due to close contact with the surface of the articles previously put in the bag.

To cope with the foregoing malfunction, it is required to use a funnel-shaped assist tool in order to prevent the surface of the article from coming in contact with the inner surface of a packing bag. Thus, there appears a problem that a packing operation takes many manhours.

SUMMARY OF THE INVENTION

The present invention has been made in consideration of the aforementioned background.

Therefore, an object of the present invention is to provide a packing assist apparatus which assures that the articles such as vegetables, fruits or flowers can be packed without an occurrence of contact of the articles with the inner surface of a packing film, and moreover, assures that an efficiency of each packing operation can substantially be improved.

According to the present invention, there is provided a packing assist apparatus which comprises a support column standing upright from a base board, a plurality of arms include a base end fitted to a rotary member disposed on the support column to be rotatable and which can be rotated in a substantially vertical plane, and a plurality of packing bag holding frames each having a through hole for allowing articles and the packing bag to pass therethrough, each of the packing bag holding frames is contoured such that the packing bag for packing the articles can be put thereon with the bottom of the packing bag oriented to one opening portion of the through hole, and the packing bag holding frames being fitted to the foremost ends of the arm.

With the packing assist apparatus of the present invention, the arms each including the packing bag holding frame (hereinafter referred simply to as the holding frame) are rotated together with the rotary member, a packing bag is put on the holding frame at a predetermined position on the movement path of the holding frames moving along a circle, and subsequently, the holding frame is rotated to another position where the articles are inserted into the packing bag put on the holding frame. When inserting of the articles into the packing bag is completed, the articles are disengaged from the holding frame together with the packing bag so that the holding frame becomes empty. When the holding frame is further rotated, it is displaced to a predetermined position for the next inserting of articles to be packed is started. Thereafter, the holding frames are rotated in the above-described manner so that packing operations are performed by repeating the foregoing steps.

Here, the procedure for inserting articles into the packing bag put on the holding frame will be described below. When the articles are thrust in the holding frame from the above packing bag after the packing bag is put on the holding frame and is displaced to a predetermined position where the bottom of the packing bag is oriented upward, the bottom is thrust downward of the holding frame by the articles and the packing bag passes through the holding frame together with the articles to be packed which are received in the packing bag with the inside of packing bag turned out, whereby an inserting operation for inserting the articles into the packing bag is terminated.

Though the surface of the articles comes in contact with the inner surface of the film in the inserting operation, there is not required any relative displacement of the articles and the film is simultaneously displaced wherein the inner surface of the film remains in contact with the surface of the articles, and thus the articles are smoothly inserted into the packing bag even though they are liable to come in tight contact with the inner surface of the film.

Next, the packing assist apparatus is characterized in that it is equipped with a click mechanism for locking the rotation of the rotary member at every predetermined angle of the rotary member. By locking the rotation of the rotary member at every predetermined angle, the holding frame is held at a predetermined position. Thus, when the packing assist apparatus is constructed such that the holding frame having a packing bag put thereon is firmly held at a predetermined position, e.g, at a horizontal position, an inserting operation for inserting the articles into the packing bag can easily be achieved.

Here, the click mechanism is characterized in that it includes recesses formed on the outer peripheral surface of a stationary shaft and ball bearings (hereinafter referred to as balls) biased to protrude from the inner peripheral surface of the rotary member so as to be fitted in the recesses at every predetermined angle of the rotary member. When balls on the inner periphery of the rotary member reach the position of the recesses on the outer peripheral surface of the stationary shaft, balls are fitted in the recesses by the biasing force of resilient members, causing the rotation of the rotary member to be obstructed. Therefore, the holding frame is held at the predetermined position, and an inserting operation for inserting articles into the packing bag put on the holding frame can be performed while the foregoing state is maintained. Since balls are disengaged from the recesses by applying power to the arm or the holding frame in the predetermined direction of rotation, it becomes possible that the holding frames are rotated.

In such a manner, the rotary member is locked every time balls reach the position of the recesses, and the holding frames are brought into the holding state. Therefore, provided that a plurality of recesses are formed on the outer peripheral surface of the stationary shaft at a predetermined angle, the holding frames can be held at the predetermined positions by locking the rotary member at every predetermined angle.

As mentioned above, the rotation of the rotary member is obstructed when balls on the inner peripheral surface of the rotary member are fitted in the recesses, whereby the holding frames are held at the predetermined positions. A disengaging guide surface adapted to allow balls to pass when they are disengaged from each recess may be formed adjacent to the recesses. If the disengaging guide surface is formed adjacent to the recess, balls are easily disengaged from the recesses when an inserting operation is completed and then the holding frames are rotated again. Namely, balls fitted in the recesses are once displaced to each disengaging guide surface from the recesses and are brought to the outer peripheral surface while sliding on the disengaging guide surface so that disengagement of balls from the recesses is smoothly achieved.

Since the disengaging surface is formed only on one side of each recess, balls are easily disengaged only when rotated in one direction (hereinafter referred to as a normal direction), and rotation of balls in the reverse direction is obstructed. When power is applied after completion of a packing operation so as to allow the rotary member to be rotated, balls are easily disengaged along the disengaging guide surface. Thus, it becomes possible that the rotary member is rotated in the normal direction. Namely, the rotary member can be rotated only in the normal direction, and moreover, balls are locked at every predetermined angle. Thus, also the arm and holding frame can be rotated only in the normal direction, and every time they reach the predetermined positions, they are immovably locked.

Here, the stationary shaft is characterized in that it comprises a spline shaft and a boss having a hole to be fitted onto the spline shaft. Since the stationary shaft has a double structure including the spline shaft and the boss to be fitted to the latter, the fitting position of the spline shaft relative to the boss can be changed. Therefore, the position of the recess on the outer peripheral surface of the boss can be changed. Since the engagement positions of the rotary member vary when the positions of the recesses are changed, the holding position of the holding frame can be changed.

On the other hand, the packing assist apparatus is characterized in that the putting means for putting the packing bag on the holding frame by rotation of the arm is rotated is disposed on a movement path of the holding frames. While the putting means is disposed on the passing path of the holding frames and each holding frame passes past the part of the placing means when the holding frames are rotated, an operation for putting the packing bag on the holding frame is performed.

The putting means is characterized in that it includes a receiving portion for holding the packing bag and a bag holding means for holding the open end of the packing bag in the opened state, and each arm is designed in a L-shaped contour. When the holding frame is rotated together with the rotary member, the holding frame fitted to the foremost end of the L-shaped arm makes access to the packing bag whose open end is held in the opened state by the putting means and the holding frame enters the packing bag through the open end so that the packing bag is put on the holding frame. At this time, since the arm is designed in the substantially L-shaped contour and the foremost end of the arm is oriented in the tangential direction of a circle described by rotation of the rotary member, the holding frame fitted to the foremost end of the arm enters the packing bag through the open end. When the holding frame is further rotated, the packing bag put on the holding frame is disengaged from the receiving portion, whereby the putting operation is terminated. Namely, since the holding frame passes past the putting means as the holding frame is rotated, putting of the packing bag on the holding frame is automatically achieved.

The bag holding means is characterized in that it is composed of a retainer for retaining a protruding end part on the open end side of the packing bag placed on the receiving portion and a blower for blowing air toward the open end of the packing bag. When air is blown toward the open end of the packing bag while the protruding end part of the packing bag placed on the receiving portion is retained by a retainer such as bag engaging pins or the like, the air enters the packing bag through the open end so that the open end of the packing bag is opened and the packing bag is largely expanded but the packing bag is held at the foregoing position by the bag engaging pins. Namely, the packing bag is held while the open end is opened and waits for access of the holding frame. The receiving portion is characterized in that it is formed on a base board from which the support column stands upright. Since the receiving portion is formed on the base board, the whole apparatus can be constructed with smaller dimensions.

The packing assist apparatus is characterized in that it is equipped with a blown air quantity adjusting means for adjustably changing the quantity of air blown from the blower. The blower serves to expand the packing bag, and an adequate blown air quantity can be determined by the blown air quantity adjusting means depending on a size of the packing bag and a speed of the packing operation. As the blown air quantity adjusting means, there can be employed means for changing the rotational speed of a blowing fan motor, a mean for disposing an adjusting gate at a suction port or a discharge port of the blower or the like.

The receiving portion is characterized in that the packing bag holding surface is designed in the form of a concave surface. Since the shape of the packing bag becomes cylindrical when the packing bag is expanded, the open end of the packing bag is easily opened when air is blown by the blower because the packing bag holding surface is previously designed in the form of a concave surface, and moreover, the expanded packing bag can be held in a stable state without any deviation in its correct position.

The packing assist apparatus is characterized in that it includes a weight for retaining only the projected part of the open end of the packing bag placed on the packing bag holding surface. An uppermost packing bag can be expanded by retaining only the projected part of the open end of the packing bag with the weight while air is blown toward the open end of the packing bag. In addition, it can be prevented that the packing bag held in the expanded state is disengaged from the bag engaging pins by the power of blown air and flies away therefrom. Therefore, putting of the packing bag on the holding frame can be achieved one by one without fail.

Here, the weight for retaining the protruding part of the open end of the packing bag is characterized in that its edge portion is designed in the comb-shaped contour. Since the contact area of the weight with the protruding end of the packing bag is decreased due to the comb-shaped contour, disengaging of the packing bag is very smoothly achieved. On the other hand, since the load of the weight is uniformly distributed by the comb-like portion, the packing bags can be held reliably.

Additionally, the weight is characterized in that it includes a protrusion at the lower part thereof, and it is fitted into a recess formed on the packing bag holding surface of the receiving portion which is detachable. While the protrusion of the weight is fitted in the recess, it is prevented that the packing bag put on the holding frame is deviated and dislocated when it is disengaged from the receiving portion. When the thickness of the laminated layer of the packing bags placed on the packing bag holding surface is decreased as the packing operation proceeds, the protrusion of the weight sinks in the recess and the whole weight is lowered. Thus, the open end of an uppermost packing bag can always be retained without fail.

On the other hand, the packing bag holding surface of the receiving portion is characterized in that it includes a protrusion or a stepped part on the surface of the packing bag holding surface of the receiving portion. Because the packing bags are placed in the laminated state, lower packing bags placed on the surface of the packing bag holding surface receive a higher intensity of pressure. Therefore, the lower packing bags have a tendency that their film surfaces come in tighter contact with each other. Thus, when the number of packing bags placed on the packing bag holding surface is reduced as they are disengaged one by one from the laminated state and the lower packing bags are used, there is a possibility that the open end of the lower packing bags is not easily opened with the blown air.

To cope with the foregoing fact, the pressure of the dead weight of the bag is distributed by forming the protrusion or stepped part on the packing bag holding surface with the result that there does not arise a malfunction that film surfaces come in tight contact with each other even though the number of packing bags is reduced. Thus, the open end of the uppermost packing bag can reliably be opened and expanded with the blown air. It is desirable that the position where the protrusion or stepped part is formed is set to a part of the packing bag holding surface corresponding to the position slightly lower than that of the open end of the packing bag, and the protrusion or the stepped part transversely extends across the packing bag. In addition, a height of the packing bag holding surface located behind the protrusion or stepped part may gradually be raised up to form an inclined surface. By forming such inclined surface in that way, the open end of the packing bag placed thereon is more easily opened.

In addition, the holding frame is characterized in that an adjusting member is adapted to come in contact with the bottom of the packing bag put on the holding frame for adjusting the putting state of the packing bag relative to the holding frame is disposed on the movement path of the holding frames. Since sometimes the packing bag is likely to be put on the holding frame by the putting means in an incomplete state, the putting state of the packing bag is required to be adjusted to obtain a reliable putting state by disposing the adjusting member on the movement path of holding frames and bringing the adjusting member in contact with the bottom of the packing bag put on the holding frame when the holding frame is rotated.

Next, the holding frame is characterized in that it is contoured such that a lower outer peripheral surface extends in parallel with the direction of extension of an axis of the holding frame, an upper outer peripheral surface extending in continuation from the lower outer peripheral surface is designed in the form of an inclined surface slantwise extending toward the axis, and the upper inner peripheral surface is designed in the form of a curved convex surface smoothly extending from an upper edge of the inclined surface in the downward direction. Here, the "axial direction" of the holding frame means the direction of a phantom line extending through the substantial center of the through hole of the holding frame. The "upper" and the "lower" of the holding frame refer to the state wherein the holding frame is located upwardly of the arm. Further, the "curved convex surface" refers to a curved surface that continuously extends without any inflection point.

Since the lower outer peripheral surface is designed in the form of a surface extending in parallel with the axial direction of the holding frame and the upper outer peripheral surface is designed in the form of an inclined surface slantwise extending toward the upper part of the axis, the whole outer peripheral surface of the holding frame generally assumes such a contour that is tapered in the upward direction. Thus, when the packing bag is put on the holding frame at the time when a putting operation is started, the placing operation can easily be performed.

In addition, when the articles are inserted into the packing bag put on the holding frame, a film surface of the packing bag assumes such a movement path that it is first raised up while sliding along the lower outer peripheral surface and the inclined surface of the holding frame extending in continuation from the latter, then it is reversed at the upper edge of the holding frame in the downward direction, and thereafter, it is lowered from the upper edge along the curved convex surface of the holding frame smoothly extending in the downward direction.

When an inserting operation is started to insert the articles, the film surface of the packing bag suspends in the downward direction to assume a state which is substantially parallel with the axis, and since the lower outer peripheral surface of the holding frame extends in parallel with the axial direction, the film surface of the packing bag suspends in a substantially parallel state with the lower outer peripheral surface. Thus, when the inserting operation is started and the film surface is raised up, displacement of the film surface is smoothly achieved along the lower outer peripheral surface of the holding frame.

Additionally, since the inclined surface extending in continuation from the lower outer peripheral surface is inclined toward the upper part of the axis, the film surface is inclined at an angle suitable for reversing the film surface at the upper edge of the holding frame as the film surface is raised up along the inclined surface.

In other words, if the film surface of the packing bag is reversed in parallel with the axis, i.e., it is reversed from the state that it is vertically raised up in the upward direction to the state that it is lowered in the downward direction as it is, it is required that the film surface is turned by an angle of 180 degrees but when the film surface is raised up along the inclined surface and then it is reversed, it is only required that the film surface is turned by the remaining angle having the inclined angle of the inclined surface subtracted from 180 degrees. Thus, the film surface can easily be reversed. Namely, since the film surface is ready to be reversed by raising up along the inclined surface, the reversing of the film surface at the upper edge of holding frame is performed very smoothly.

When the film surface is reversed at the upper edge of the holding frame, an adequate gap appears between the reversed part of the film surface and the upper edge of the holding frame since the film surface is displaced first along the inclined surface and then along the curved convex surface smoothly curved from the upper edge in the downward direction. Owing to the foregoing gap, tight contact between the film surface and the holding frame is prevented and reversing of the film surface is smoothly conducted. In addition, since the curved convex surface is designed in the form of a curved convex surface smoothly curved without any inflection point, subsequent slippage of the film surface along the lowering path is achieved excellently.

Next, the holding frame is characterized in that an inner peripheral surface of the holding frame extending from the curved convex surface to the lower end of the holding frame is recessed in such a direction that an inner diameter of the holding frame is increased. Therefore, since a cavity is formed along the whole inner periphery of the holding frame, and the packing bag with the articles inserted therein is lowered below the position of the lower edge of the curved convex surface, no restriction to the packing bag disappears, causing the packing bag to be smoothly lowered.

In addition, the inclined surface of the holding frame is characterized in that an inclined angle of the inclined surface relative to the axial direction of the holding frame is set to the range of 30 to 45 degrees, and the position of a boundary between the inclined surface and the lower outer peripheral surface and the position of a lower edge of the curved concave surface are located higher than about a half of the height from the lower end to the upper end of the holding frame. As mentioned above, if the film surface of the packing bag is reversed downwardly from the state that the film surface is raised up as it is, it is required that the film surface is turned by an angle of 180 degrees but when the inclined angle of the inclined surface is set to the range of 30 to 45 degrees, it is only required that the inclined surface of the packing bag is turned by the remaining angle, viz, 150 to 135 degrees. Thus, the reversing of the film surface is achieved very smoothly.

In such a manner, when the inclined angle of the inclined surface is set to 30 to 45 degrees relative to the axis of the holding frame, the state of slippage and reversing of the film surface of the packing bag can be optimized. In the case where the inclined angle is set to less than 30 degrees, the reversing of the film surface of the packing bag is not performed smoothly because that angle provides a weak function to the film surface of the packing bag, and in the case that it is set to more than 45 degrees, the frictional resistance appearing between the inclined surface and the film surface becomes large. Thus, the slippage of the film surface is not conducted smoothly.

On the other hand, when the position of the boundary between the inclined surface and the lower outer peripheral surface and that of the lower edge of the curved convex surface are located higher than a half of the height from the upper end of the holding frame to the lower end of the same, the length of the lower outer peripheral surface and the length of the cavity as measured in the upward direction are relatively elongated. Consequently, the function of guiding of the packing bag in the vertical direction is improved, and moreover, the reversing and slippage of the packing bag are achieved smoothly.

Next, the holding frame is characterized in that each of the holding frames assumes a circular or elliptic shaped contour. In the case that the holding frame is designed in the circular shaped contour, the articles are inserted in the state that they are collectively received in the central part of the packing bag and they are uniformly packed in the packing bag viewed from all directions. Thus, a packing operation can be performed regardless of the direction of insertion of the articles.

On the other hand, in the case that the holding frame is designed in the elliptic shaped contour, the articles are not collectively received in the central part of the packing bag but are packed in the flattened state in the side-by-side relationship, and therefore they are readily recognized from the outside after they are packed in the packing bag. This provides a merit wherein the packing bag with the articles received therein exhibits an excellent aesthetic appearance when it is put on a display case or shelf. In such a manner, since the packing state can be changed by designing the holding frame in the circular or elliptic shaped contour, a packing operation can adequately be performed depending on the kind, shape or nature of the articles.

Since the articles can smoothly be inserted into the packing bag regardless of the contour of the circular or elliptic shaped holding frame, each packing operation can effectively be performed.

Next, the packing assist apparatus is characterized in that a guard member is disposed between the holding frame and the arm. When the packing bag does not straightforwardly fall but falls in the inclined state after the articles are inserted into the packing bag put on the holding frame and they pass past the holding frame, the packing bag comes in contact with the guard member for preventing it from being inclined relative to the axial direction of the holding frame, whereby the lowering of the packing bag is guided straightforwardly in the downward direction. Thus, the packing bag smoothly passes through the holding frame. The aesthetic appearance of the packing bag is not degraded after the completion of each packing operation because the inserted state of the articles is not worsened with such an inclination of the packing bag prevented.

On the other hand, the arms are characterized in that each of the arms is designed to be expansible and contractible. It becomes possible that the position of the holding frame is changed depending on the length of articles when the arms are designed to be expansible and contractible. In addition, by changing the position of the holding frame depending on an operators attitude, he can perform a packing operation without any difficulty.

Next, the arms are characterized in that each of the arms can be connected to and disconnected from the rotary member. By enabling the arms to be connected to and disconnected from the rotary member, it becomes possible to exchange each arm with another arm having adequate shape and size depending on the kind, size or the like of articles. On the other hand, by disconnecting the arm with the holding frame fitted thereto from the rotary member and then fitting to another stationary stand or the like, it can be used as a stationary packing assist instrument.

In addition, the holding frame is characterized in that it can be connected to and disconnected from each arm. By enabling the holding frame to be connected to and disconnected from the arm, it becomes possible to exchange the holding arm with another one depending on the kind, shape, nature or the like of articles to be packed. Thus, each packing operation can effectively be performed. In addition, by disconnecting only the holding frame and then fitting it to a support column standing upright from a stationary board or the like, it can be used as a stationary packing assist instrument.

The holding frame is characterized in that the position where it is fitted to the arm can be changed. By enabling the holding frame to be connected to and disconnected from the arm, it can cope with the kind, shape, nature or the like of articles. When the fitting position of the holding arm is changed depending on an operator's attitude and his working conditions, he can perform a packing operation without any difficulty.

The rotary member is characterized in that a plurality of arms are connected to the rotary member in an equally spaced angular relationship. When they are connected to the rotary member in the equally spaced angular relationship, a putting operation for putting the packing bag on the holding frame and an inserting operation for inserting articles into the packing bag can successively and effectively be performed.

The rotary member is characterized in that three to four arms are connected to the rotary member. By using three arms, the distance between adjacent arms is optimized, and a placing operation for placing the packing bag to the holding arm and an inserting operation for inserting articles into the packing bag can successively and effectively be performed. When two or less arms are used, an efficiency of the packing operation is degraded, and when four or more arms each having a short length are used, the distance between adjacent arms becomes excessively short so that there appears a tendency that each packing operation is obstructed due to contact of the open end of the packing bag put on the holding frame with the adjacent arm. However, when each arm has a relatively long length, four arms can be connected to the rotary member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

The present invention will be described in detail hereinafter with reference to the accompanying drawings which illustrate preferred embodiments thereof.

Figure 1:
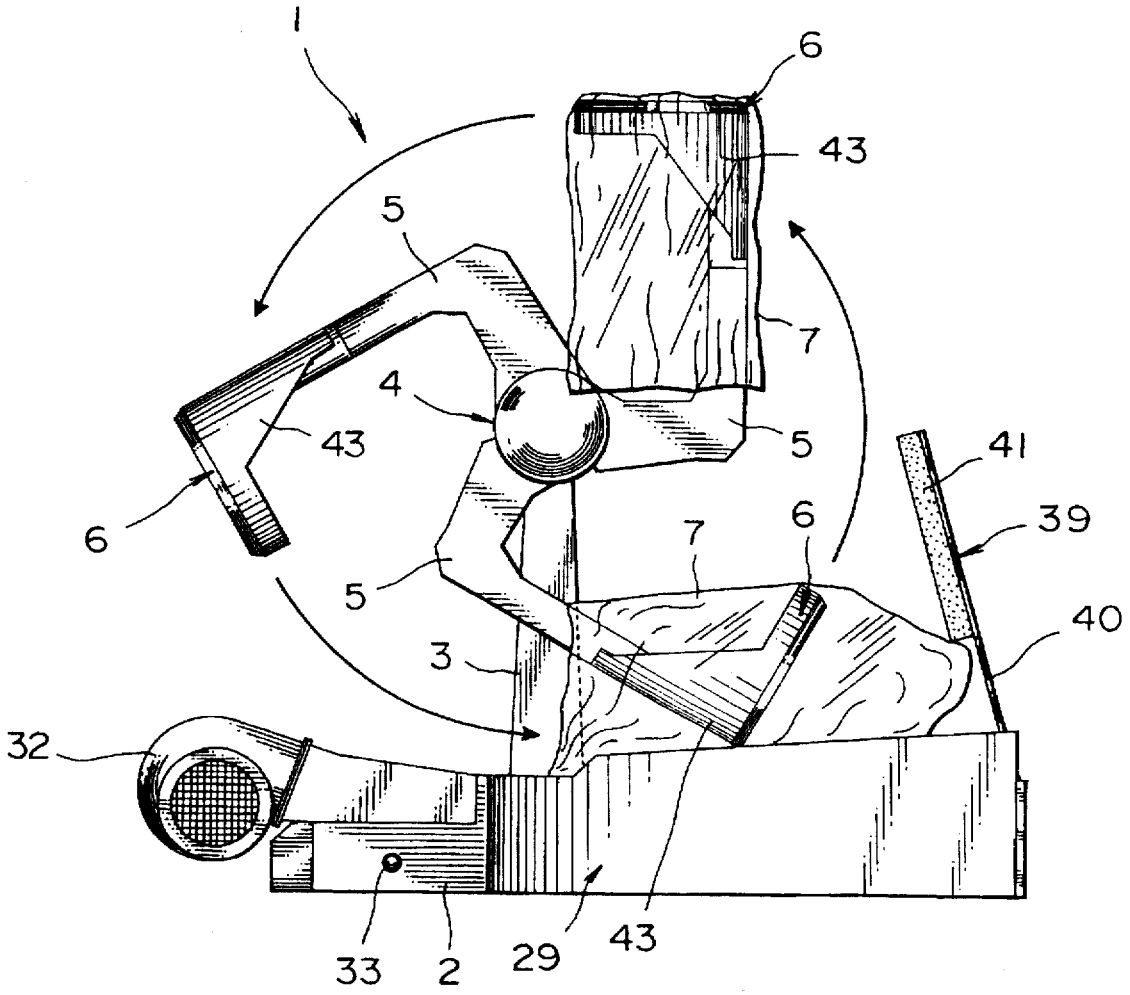
FIG. 1 is a perspective view of a packing assist apparatus constructed in accordance with the first embodiment of the present invention.
Figure 2:
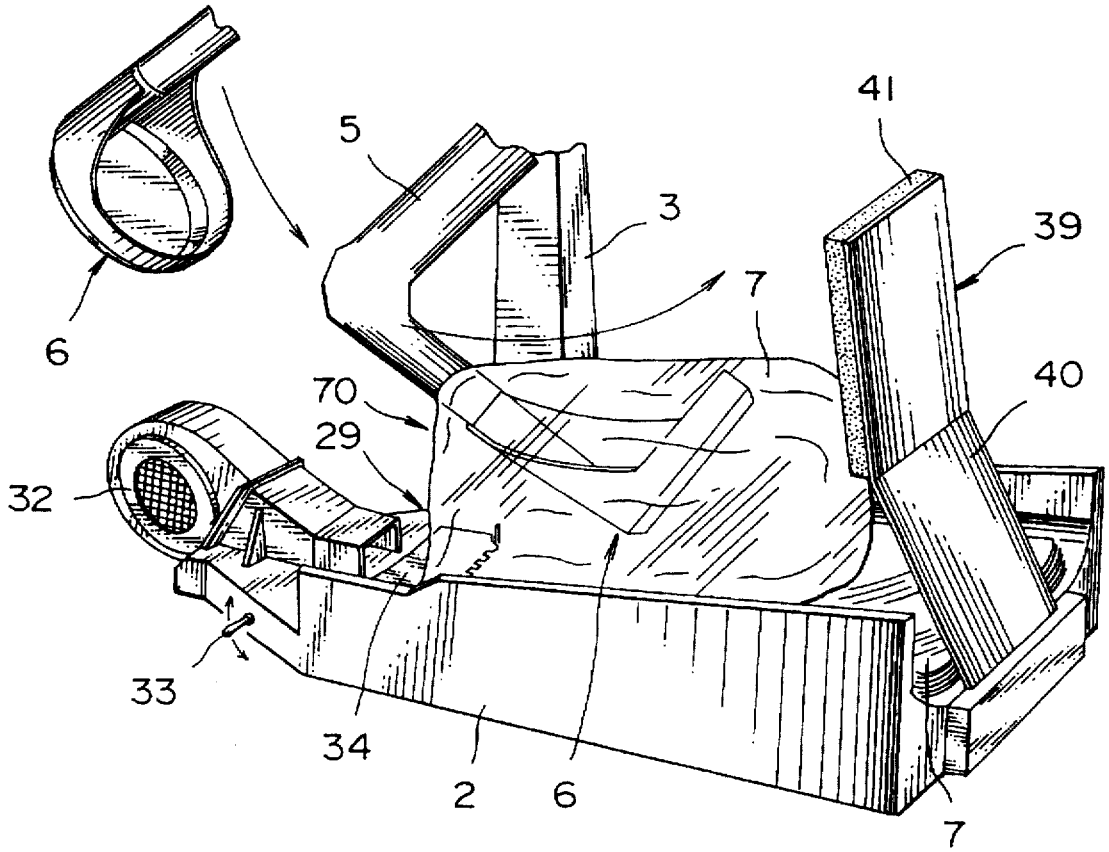
FIG. 2 is a fragmentary enlarged perspective view of the packing assist apparatus constructed in accordance with a first embodiment of the present invention.
Figure 3:
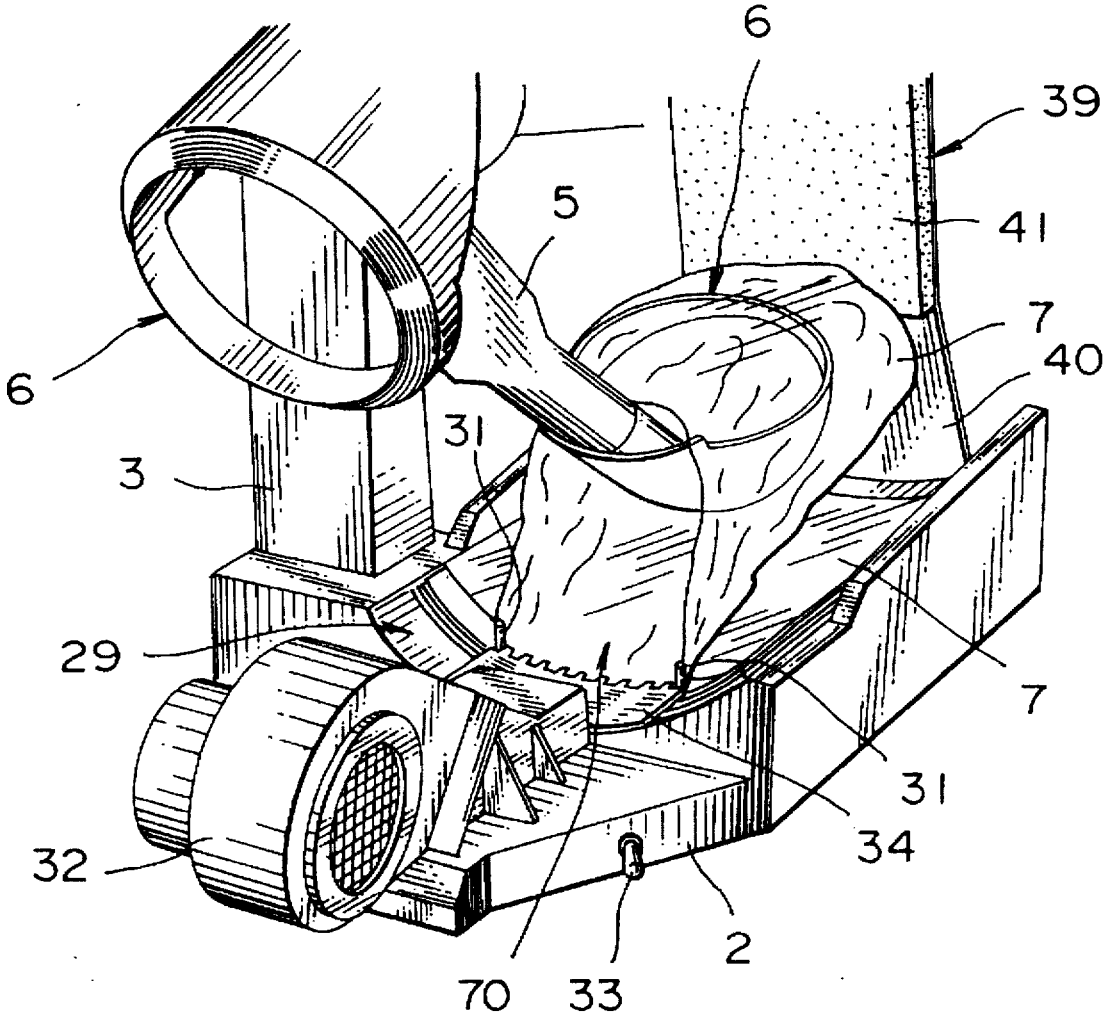
FIG. 3 is another fragmentary enlarged perspective view of the packing assist apparatus constructed in accordance with the first embodiment of the present invention.

FIG. 1 is a perspective view of a packing assist apparatus constructed in accordance with the first embodiment of the present invention, and FIG. 2 and FIG. 3 are perspective views of the packing assist apparatus shown in FIG. 1. In this embodiment, the packing assist apparatus 1 includes a rotary member 4 which is held at the top of a support column 3 standing upright from a base board 2, and three L-shaped arms 5 are attached to the rotary member 4. A holding frame 6 having an opening hole through which articles pass is attached to the foremost end of each arm 5.

The packing assist apparatus 1 shown in FIG. 1 is constructed such that a packing bag 7 is put on a holding frame 6 by rotating the folding frames 6 counterclockwise in the vertical plane, together with the rotary member 4, and then the holding frame 6 is locked at a position after it has been further rotated counterclockwise so that articles 8 can be inserted into the packing bag 7. In other words, the packing bag 7 is put on the holding frame 6 when the holding frame 6 passes past a bag supplying portion disposed below the rotary member 4, the holding frame 6 carrying the bag 7 is locked by a click mechanism after it has been further rotated counterclockwise to a predetermine position, and then, articles are inserted into the packing bag 7 put on the holding frame 6 in the locked state.

On completion of the inserting operation of the articles into the packing bag 7, the articles 8 are released from the holding frame 6 together with the packing bag 7, causing the holding frame 6 to assume again on the empty state. Then, when a force effective in a counterclockwise direction is applied to the holding frame 6, so as to release the click mechanism from the operative state the holding frame 6 is rotated to the bag supplying position. As the holding frame 6 passes past the bag supplying position, another packing bag 7 is put on the holding frame 6 again. When the holding frame 6 is rotated to the right upper position, it is locked at the upper right position by the click mechanism so that next articles begin to be inserted into the packing bag 7. Thereafter, by repeating the aforementioned steps by the rotation of the holding frame 6, the packing bag 7 is put on the holding frame 6 and then articles are inserted into the packing bag 7. Thus, since the packing bag 7 can continuously be put on the holding frames 6 and the articles can continuously be inserted into the packing bag 7 by operating the packing assist apparatus 1, an efficiency of each packing operation is substantially improved.

Here, a procedure for inserting articles into the packing bag 7 put on the holding frame 6 will be described below with reference to FIGS. 4(*a*) to (*c*). When the holding frame 6 on which has been put the packing bag 7 is rotated to the right upper position, the state shown in FIG. 4(*a*) is assumed.

Figure 4C:
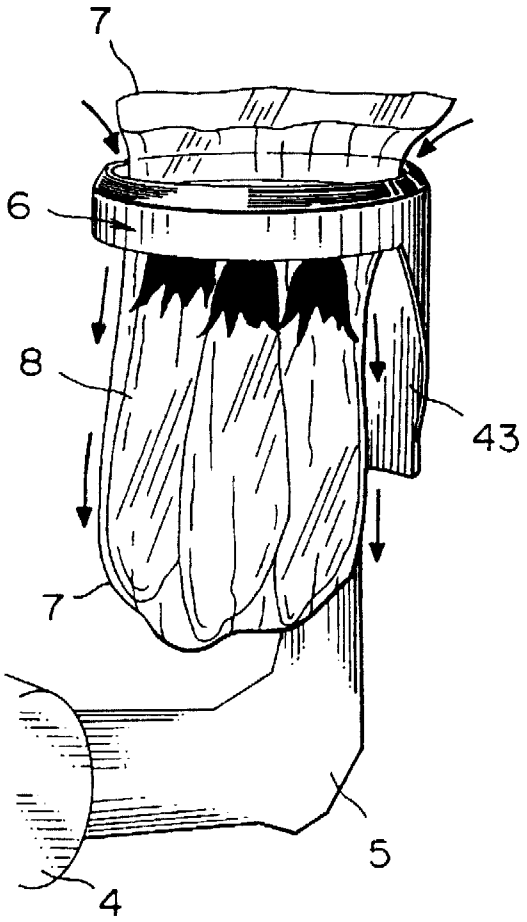
Figure 4B:
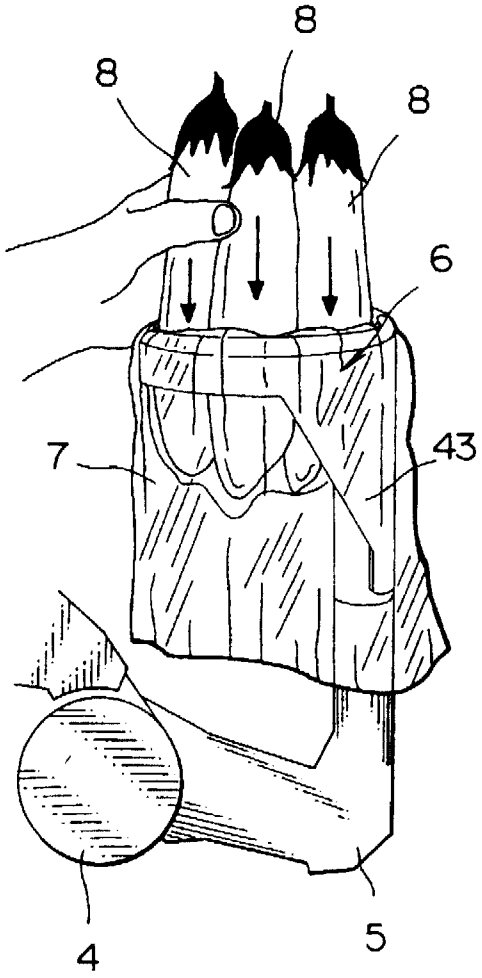
Figure 4A:
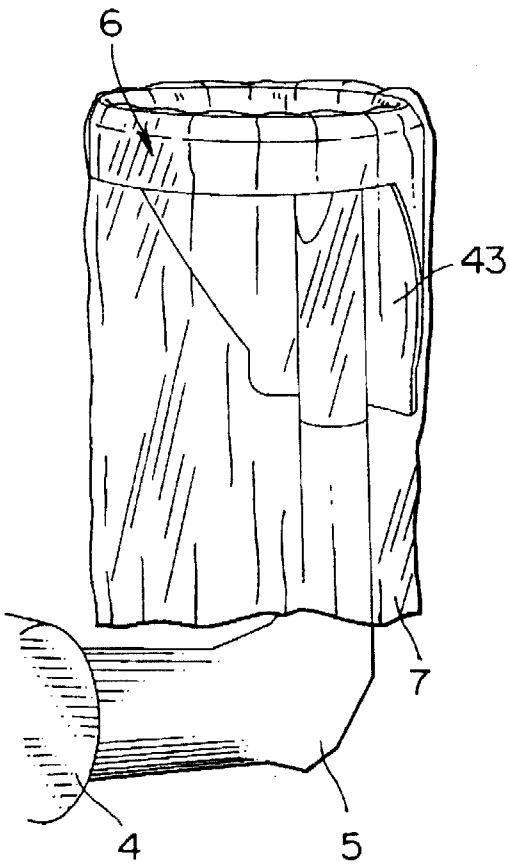

Next, when articles 8 to be packed are squeezed in the holding frame 6 from above as shown in FIG. 4(*b*), the bottom of the packing bag 7 is thrust downward of the holding frame 6, and the main body of the packing bag 7 passes through the holding frame 6 so as to wrap articles 8 therewith while it is turned inside out.

Further, when articles 8 are squeezed in the holding frame 6, they pass through the holding frame 6 together with the packing bag 7 as shown in FIG. 4(*c*), and finally, they are discharged downward of the holding frame 6, whereby an inserting operation is terminated.

During the foregoing inserting operation, the surface of articles 8 comes in contact with the film surface of the packing bag 7 without any relative displacement therebetween, and since the surface of articles 8 and the film surface are simultaneously displaced while maintaining the contact state therebetween, an inserting operation is very smoothly performed even though each of the articles 8 has a smooth surface which adheres to the film surface.

Figure 5:
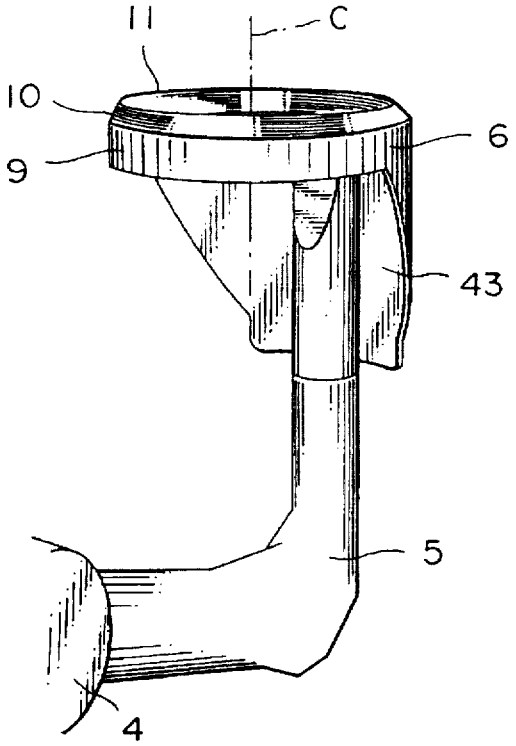
FIG. 5 is a perspective view which shows a holding frame and an arm.
Figure 6:
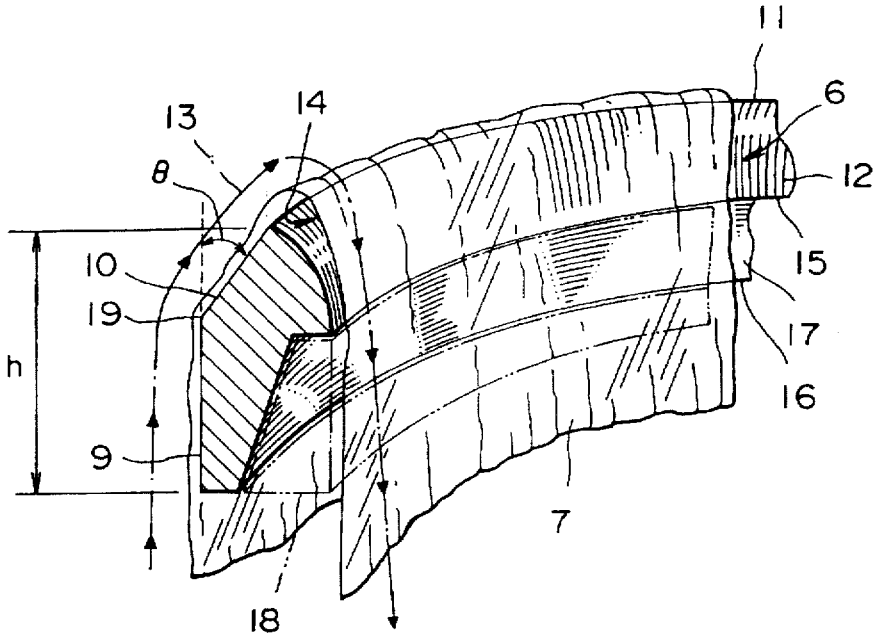
FIG. 6 is a partially exploded perspective view of the holding frame.

Next, the configuration, function and so forth of the holding frame 6 will be described in detail with reference to FIGS. 5 and 6. FIG. 5 is a perspective view of the arm 5 and the holding frame 6, and FIG. 6 is a partially exploded enlarged perspective view of the holding frame 6. As shown in the drawings, the lower outer peripheral surface 9 of the holding frame 6 is a surface extending in parallel with the direction of a phantom axis C extending through the center of the through hole of the holding frame 6, the upper outer peripheral surface extending upwardly of the lower outer peripheral surface 9 is an inclined surface 10 slantwise extending toward the axis C, and the upper inner peripheral surface of the holding frame 6 is a curved convex surface 12 smoothly continuously extending from the upper edge 11 of the inclined surface 10 in the downward direction in the curved state without any infection point. Here, the upper ends and lower of the respective surfaces of the holding frame 6 are taken based on the state as shown in FIG. 5 wherein the holding frame 6 is located above.

Since the lower outer peripheral surface 9 of the holding frame 6 is a surface extending in parallel with the direction of the axis C and the inclined surface 10 extends in continuation from the lower outer peripheral surface 9 as described above, the whole outer peripheral surface of the holding frame 6 assumes a configuration which is tapered in the upward direction. Thus, when the packing bag 7 is put on the holding frame 6 by using a putting means described latter, the putting operation of the packing bag 7 on the holding frame 6 can easily and reliably be achieved.

When articles 8 are inserted into the packing bag 7 put on the holding frame 6, a moving displacement path 13 of the film surface is such that the film surface of the packing bag 7 is first raised up while sliding along the lower outer peripheral surface 9 of the holding frame 6 and the inclined surface 10 extending in continuation from the latter, subsequently, it is turned in the downward direction at the position located in the vicinity of the upper edge 11 of the holding frame 6, and thereafter, it is lowered while sliding along the curved convex surface 12.

When the above inserting operation of the egg-apples 8 starts, the film surface of the packing bag 7 put on the holding frame 6 is suspended in a substantially parallel position with the lower outer periphery surface 9. Thus, also in the case where the film surface of the packing bag 7 is raised up, the film surface is smoothly displaced along the lower outer periphery surface 9.

In addition, since the inclined surface 10 extending in continuation from the lower outer peripheral surface 9 is inclined toward the axis C, the film surface is inclined at an angle suitable for reversion thereof in the proximity of the upper edge 11 of the holding frame 6.

In other words, the film surface of the packing bag 7 is reversed directly in the downward direction from the state raised up in parallel with the axis C, i.e., in a complete upward direction, it is required that the film surface is turned by an angle of 180 degrees. However, when the film surface is first raised up along the inclined surface 10 with an inclination angle θ degree relative to the axis C set to the range of 35 to 40, and then reversed, then a turning angle θ of the inclined surface 10 is by angle in the range of 150 to 135 degrees subtracted from 180 degrees by an angle of 30 to 45 degrees, and reversion of the film surface is very smoothly achieved.

Incidentally, in the case where the inclination angle is less than 30 degrees, the inclined surface 10 functions insufficiently with the result that reversion of the film surface is not smoothly achieved. On the contrary, in the case where it is larger than 45 degrees, frictional resistance between the inclined surface 10 and the film surface is increased and thereby sliding movement of the film surface fails to be smoothly conducted.

Additionally, in the case where the film surface of the packing bag 7 is reversed in the vicinity of the upper edge 11 of the holding frame 6, there is formed an adequate amount of a gap 14 between the reversed part of the film surface and the upper edge 11. Consequently, close contact between the film surface and the holding frame 6 is prevented, enabling reversion of the film surface to be smoothly conducted. Since the curved convex surface 12 is a continuous surface smoothly curved without any inflection point, subsequent sliding of the film surface along the downward displacement path 13 becomes very smooth.

Next, an inner peripheral surface 17 of the holding frame 6 extending from a lower edge 15 of the curved convex surface 12 is recessed such that the inner diameter of the holding frame 6 increases and a cavity 18 is formed along the whole peripheral between the inner peripheral surface 17 and the packing bag 7. Thus, when the packing bag 7 having the egg-apples 8 received therein is lowered from the lower edge 15 of the curved convex surface 12, it is smoothly displaced in the downward direction without any particular restriction. On the other hand, both a boundary 19 between the inclined surface 10 and the lower outer peripheral surface 9 and the lower edge 15 of the curved convex surface 12 are respectively located at the positions higher than about a half of a height h between a lower edge 16 of the holding frame 6 and the upper edge 11. Accordingly, the vertical length of the lower outer peripheral surface 9 of the holding frame 6 is relatively elongated, causing the guiding function of the packing bag 7 to become effective, and since the length of the cavity 18 is also relatively elongated, reversion and sliding movement of the packing bag 7 caused when the an inserting operation is performed are smoothly in the stable state.

Figure 7:
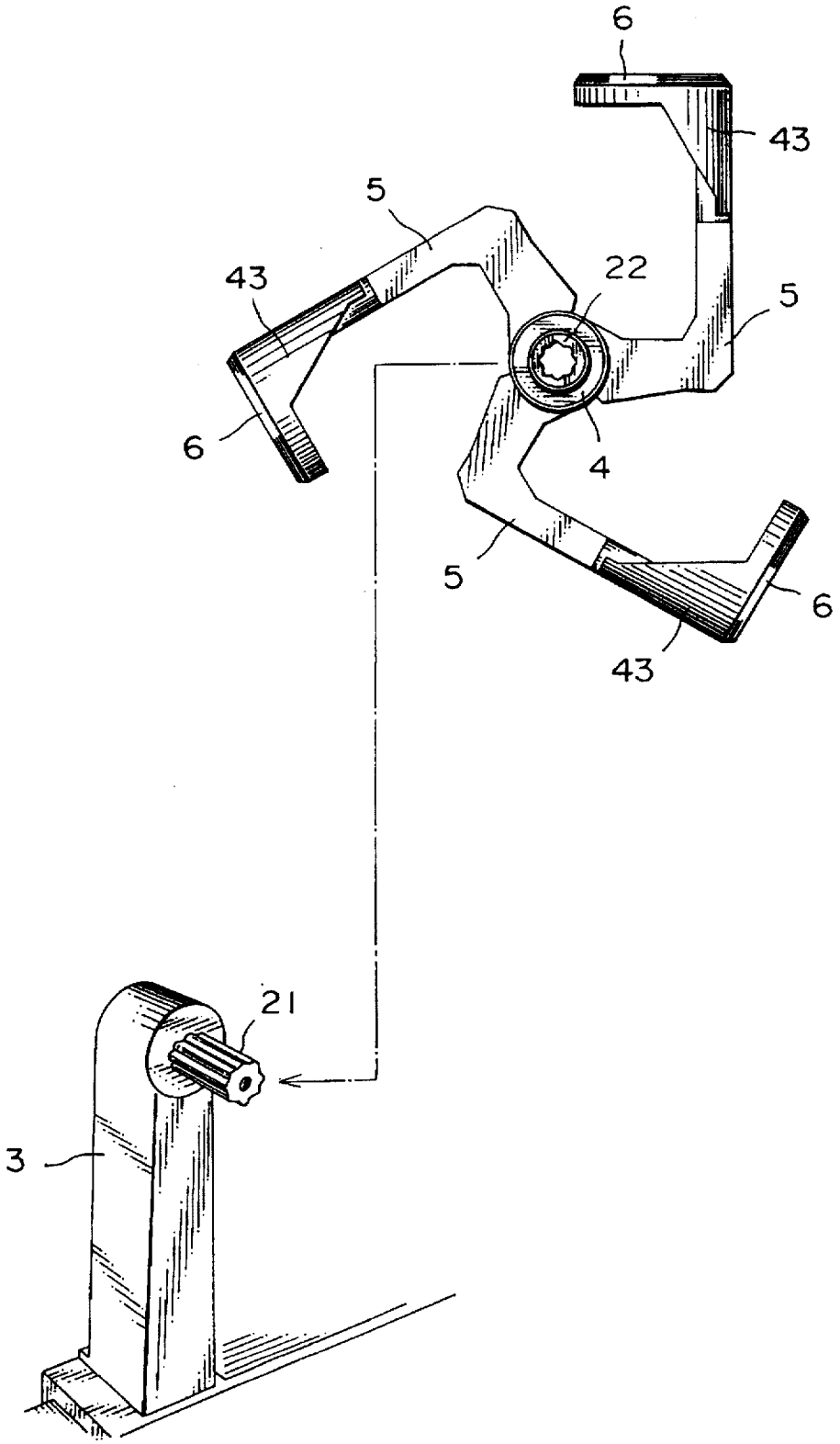
FIG. 7 is a perspective view which shows the packing assist apparatus in a disconnected state.
Figure 8:
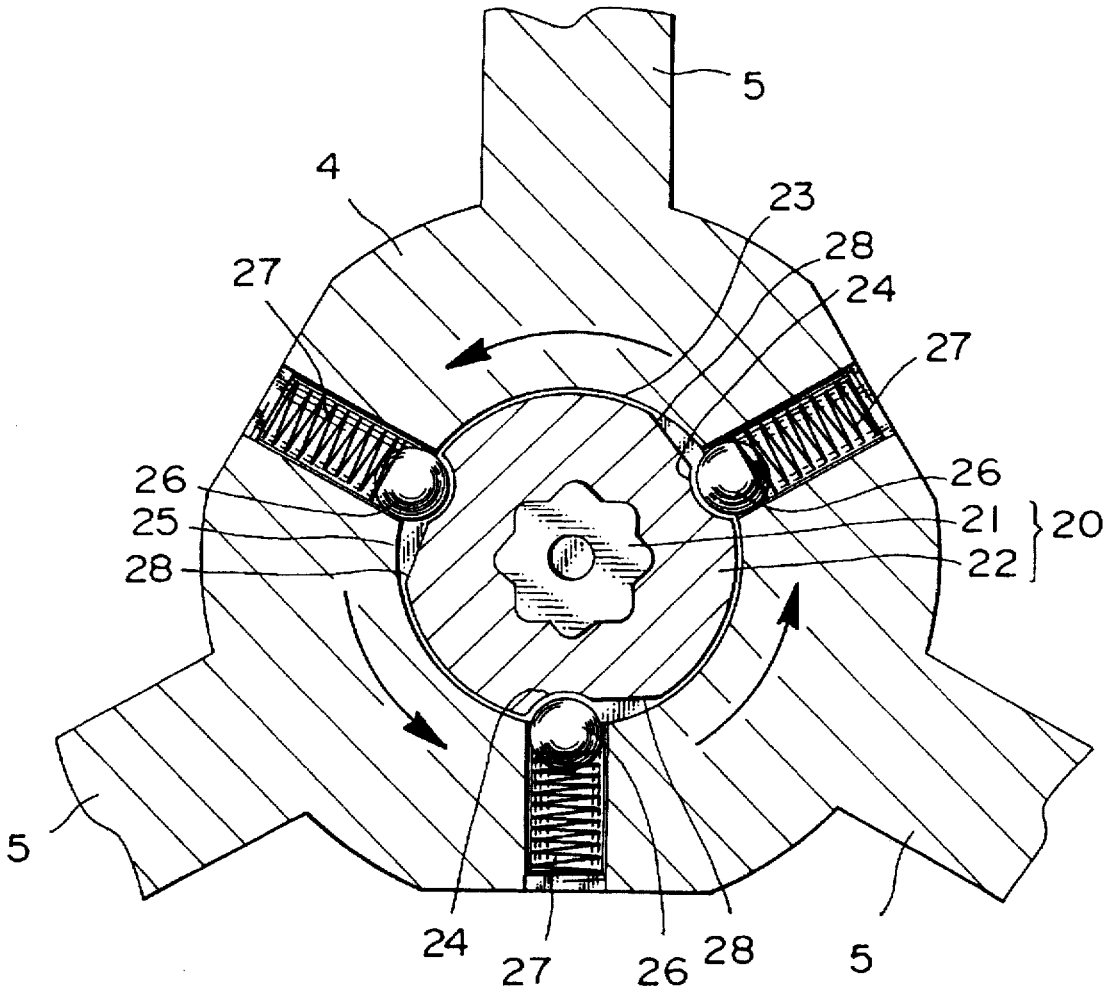
FIG. 8 is an enlarged sectional view which shows a rotary member and a stationary shaft portion.

Next, the click mechanism for the rotary member 4 will be described below with reference to FIG. 7 and FIG. 8. FIG. 7 is a perspective view which shows a state before the rotary member 4 including three arms 5 and three holding frames 6 is fitted to the support column 3, and FIG. 8 is an enlarged vertical sectional view which shows a state where the rotary member 4 is fitted to the support column 3. The packing assist apparatus 1 is provided with the click mechanism for locking the rotary member 4 at every 120 degrees. The click mechanism comprises three ball bearings (hereinafter referred to as balls) 26 adapted to protrude from an inner peripheral surface 25 of the rotary member 4 when the holding frames 6 are rotated counterclockwise and three springs 27 for biasing the balls 26 toward an outer peripheral surface 23 of a stationary shaft 20. When the rotary member 4 is rotated counterclockwise and each ball 26 reaches the position of a recess 24 on the outer peripheral surface 23 of the stationary shaft 20, the balls 26 are fitted into the recesses 24, causing the rotation of the rotary member 4 to be prevented. At this time, since the holding frame 6 when located at the upper right position assumes a horizontal state, an inserting operation for egg-apples 8 can be performed while the foregoing horizontal state is maintained. On completion of the inserting operation, the balls 26 are disengaged from the recesses 24 with a rotary force in the counterclockwise direction applied to the arm 5 or the holding frame 6 and it is rotated in the same direction.

In such a manner, every time the balls 26 reach the position of the recesses 24, the rotary member 4 is locked so that the holding frame 6 is brought to a holding state. Thus, provided that a plurality of recesses 24 are disposed on the outer peripheral surface 23 of the stationary shaft 20 at predetermined angles, the holding frames 6 can be held at the predetermined positions by locking the rotary member 4 at every predetermined angle.

Here, the structure of the stationary shaft 20 will be described in detail below. As shown in FIG. 8, the stationary shaft 20 is constructed in the double structure including a spline shaft 21 and a boss 22 fitted onto the spline shaft 21. Since the boss 22 constitutes a part of the click mechanism, it is fitted to the rotary member 4 side, and as shown in FIG. 7, it can be connected and disconnected to the spline shaft 21 together with the rotary member 4. Therefore, by changing the fitting position of the boss 22 relative to the spline shaft 21, the position of the recesses 24 on the outer peripheral surface 23 of the boss 22 can be changed along the direction of rotation.

In addition, a disengaging guide surface 28 for allowing the balls 26 in the recesses 24 to pass when they are disengaged from the recesses 24 are formed on an counterclockwise side adjacent to the recesses 24. Since the disengaging guide surface 28 is formed adjacent to the recesses 24 as mentioned above, the balls 26 can easily be disengaged from the recesses 24 when the holding frame 6 is rotated again after completion of each inserting operation. Namely, since the balls 26 in the recesses 24 are once displaced onto the disengaging guide surface 28 from the recesses 24 and then moves to the outer peripheral surface 23 of the stationary shaft 20 while sliding on the disengaging guide surface 28, they can be smoothly disengaged from the recesses 24.

Since the disengaging guide surface 28 is formed only on one counterclockwise side of the recesses 24, disengagement of the balls 26 are easily achieved only when the rotary memory 4 is rotated counterclockwise. Namely, since the rotary member 4 can be rotated only in a counterclockwise direction, and it is locked at every 120 degrees, each holding frame 6 can be rotated only in the counterclockwise direction and immovably held when displaced to the predetermined position.

Next, as shown in FIGS. 1 to 3, the bag supplying means for putting the packing bag 7 on of the holding frame 6 upon rotation of the rotary member 4 is disposed below the stationary shaft 20 along the movement path of the holding frames 6. Rotating each holding frame 6 together with the rotary member 4, the packing bag 7 is put on the holding frame 6 by the bag supplying means.

The bag supplying means comprises a receiving portion 29 for placing the packing bag 7 and bag holding portion described latter for holding an open end 70 of the packing bag 7 in an opened state. The receiving portion 29 is such that when the holding frame 6 is rotated together with the rotary member 4, it makes access to the packing bag 7 with the open end 70 held in the opened state, and is brought into the interior of the packing bag 7 through the open end 70 to assume the state that the packing bag 7 is put on the holding frame 6. When the holding frame 6 is further rotated, the packing bag 7 put on the holding frame 6 is disengaged from the receiving portion 29 and a putting operation is completed. As the holding frame 6 is rotated, it passes past the bag supplying means and the putting of the packing bag 7 on the holding frame 6 is automatically conducted.

Figure 9:
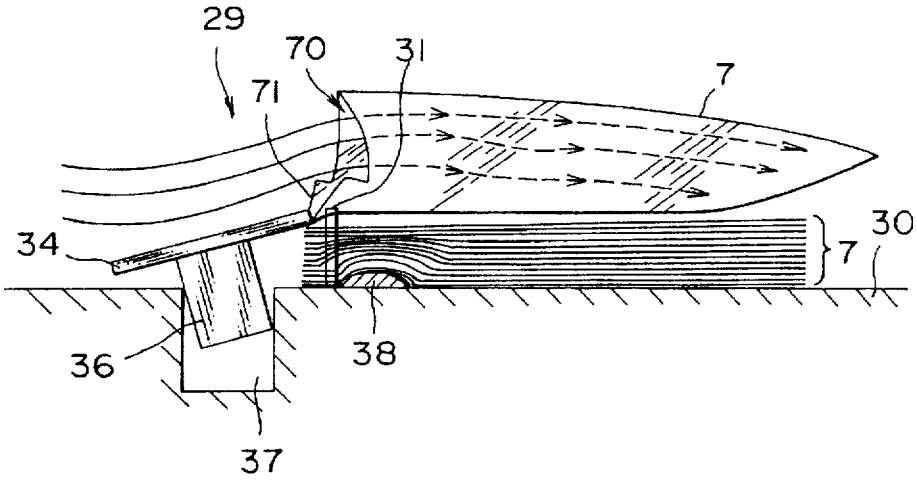
FIG. 9 is a front view which shows the packing bag in an opened state.
Figure 10:
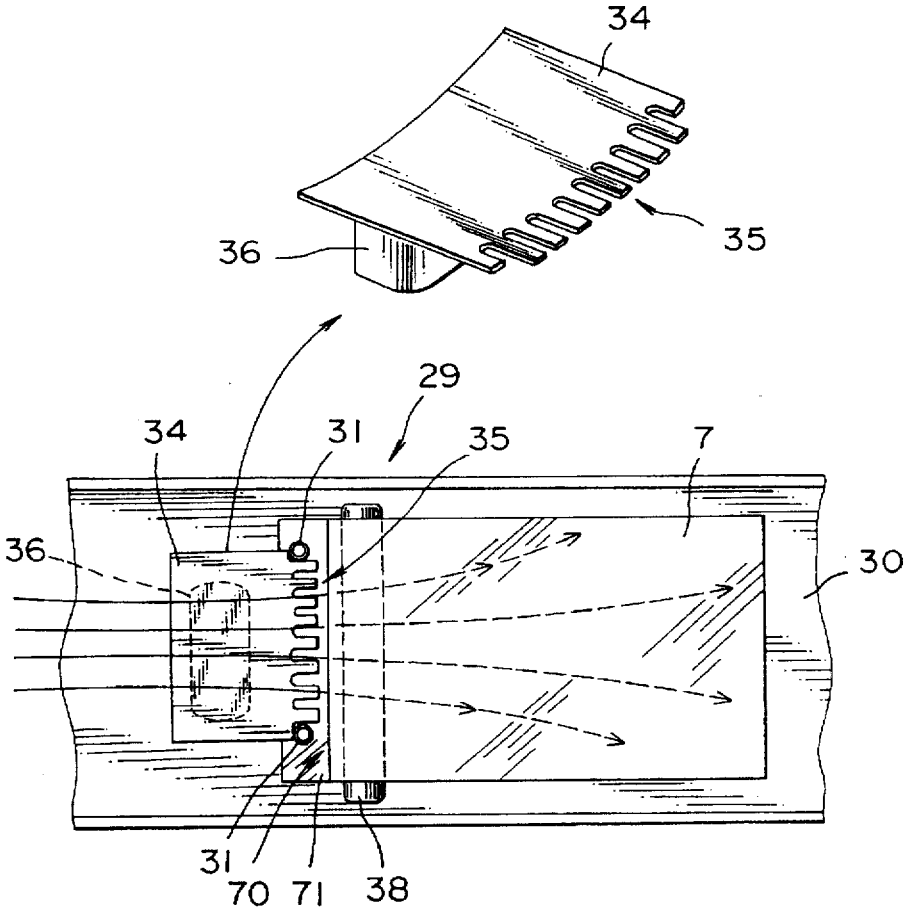
FIG. 10 is a plane view which shows the packing bag in an opened state.

As shown in FIGS. 1, 9 and 10, the bag holding portion comprises a bag holding pins 31 projecting upright from a packing bag holding surface 30 of the receiving portion 29 and a blower 32 for blowing air toward the open end 70 of the packing bag 7. When air is blown toward the open end 70 of the packing bag 7 with a protruded end part 71 of the packing bag 7 held by its bag holding pin 31, it enters the packing bag 7 through the open end 70 of the latter so that the packing bag 7 is largely expanded. However, the packing bag 7 held by the bag holding pins 31 is retained on that position. Namely, the packing bag 7 is retained while the open end 70 is kept opened, and is ready for an access by the holding frame 6.

Here, a shift switch 33 for changing the rotational speed of a blower fan motor is disposed for the purpose of changing a quantity of air blown from the blower 32. Thus, by shifting the shift switch 33, an adequate quantity of blown air can be determined depending on a size of the packing bag 7 and an operational speed of the packing operation. Besides, an adjusting gate can be arranged at a suction port or a discharge port of the blower 32 as a blown air quantity adjusting means.

Figure 11:
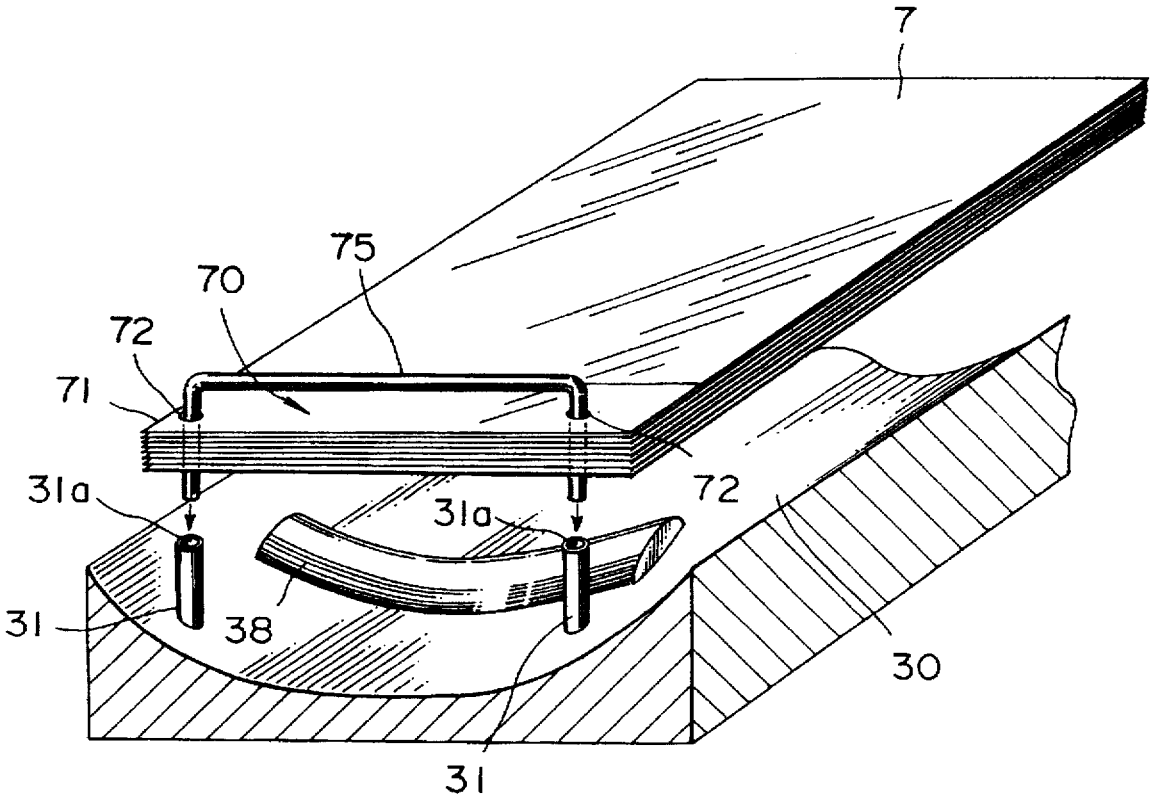
FIG. 11 is a perspective view which shows a procedure of placing the packing bags.

Next, as shown in FIG. 11, the packing bag holding surface 30 is designed in the form of a concave surface. Since the packing bag 7 assumes a cylindrical shape when it is expanded with the blown air, the open end 70 of the packing bag 7 can easily be opened with the blown air because the packing bag holding surface 30 is previously designed in the form of a concave surface, and moreover, the expanded packing bag 7 can be held in the stable state without any deviation from the correct position.

As shown in FIGS. 9 and 10, the projecting end part 71 on the open end 7 side of the packing bag 70 is retained with a weight 34. By retaining the projecting end part 71 of the packing bag 7 with the weight 34, only an uppermost packing bag 7 can be expanded when air is blown toward the open end 70. In addition, the expanded packing bag 7 held in the waiting state can be prevented from being disengaged from the bag holding pins 31 by the force of blown air and prevented from flying away therefrom. Consequently, the putting of the packing bag 7 on each holding frame 6 can be achieved one by one without fail.

Here, an edge portion 35 of the weight 34 is designed in the form of a comb shape. Since a contact area of the weight 34 with the projecting end part 71 of the packing bag 7 placed thereon is reduced by designing the edge portion 35 in the form of a comb shape, disengagement of the packing bag 7 is smoothly achieved. On the other hand, since the load of the weight 34 is uniformly distributed on the comb shape portion thereof, the packing bag 7 can reliably be held. In addition, a projecting portion 36 is disposed at the lower portion of the weight 34, and it is received in a recess 37 of the packing bag holding surface 30. While the projecting portion 36 is received in the recess 37, there does not arise such a malfunction that when the packing bag 7 put on the holding frame 6 is removed the bag receiving portion 29, so that the weight 34 is deviated or dislocated from its correct position. When a packing operation proceeds and thus a thickness of the laminated layer of the packing bags 7 is correspondingly reduced, the projecting portion 36 of the weight 34 is increasingly lowered and lastly the whole weight 34 sinks. Thus, the projecting end part 71 of an uppermost packing bag 7 is always retained with the weight 34 without fail.

On the other hand, a projection 38 is formed on the packing bag holding surface 30. Since the packing bags 7 are held in the laminated state, a lower packing bag 7 receives a higher intensity of pressure due to the dead weight of the laminated structure of the packing bags 7. Thus, a lower packing bag 7 has such a higher tendency that films come in close contact with each other. Consequently, as the packing bags 7 leave one after the other, the number of packing bags 7 received on the packing bag holding surface 30 decreases, and when a lower packing bag 7 is used for the purpose of packing, there arises an occasion that its open end 70 can not easily be opened with the blown air.

To cope with the foregoing malfunction, the projection 38 is formed on the packing bag holding surface 30 so as to distribute the pressure of dead weight of the packing bag 7 placed on the projection 38 with a result that an intensity of pressure effective in the vertical downward direction is decreased in order to prevent film surfaces of the packing bag 7 from coming in tight contact with each other. Accordingly, even though the number of packing bags received on the packing bag holding surface 30 is decreased, there does not arise such a malfunction that film surfaces come in tight contact with each other. As air is blown from the blower 32, the open end 70 of an uppermost packing bag 7 is opened to expend without fail. Incidentally, it is desirable that the position of the projection 38 is formed on the receiving surface 30 to be set slightly in the vicinity of the opening portion 70 of each packing bag 7 and along the open end 70. Instead of the projection 38, a stepped part may be formed at the same position and in the same direction as that of the projection 38 in such a manner that the height of a packing bag holding surface 30 located rearward of the stepped part is gradually raised up in the form of an inclined surface. Formation of the packing bag holding surface 30 in the shape of an inclined surface has a merit that the open end of a packing bag received on the inclined surface can more easily be opened.

Here, a method of setting the packing bags 7 on the packing bag holding surface 30 will be described below with reference to FIG. 11. Engagement holes 72 are previously formed on both opposite sides of the projecting end part 71 of each packing bag 7 so that the opposite ends of an inverted U- shaped staple 75 are inserted through the engagement holes 72 Next, the opposite ends of the staple 75 are inserted into holes 31*a* formed at the upper parts of the bag holding pins 31 so that the opposite ends of the staple 75 are jointed to the bag holding pins 31, and while the foregoing state is maintained, the packing bags 7 are displaced to the bag holding pins 31. When all the packing bags 7 are displaced to the bag holding pins 31, the staple 75 is drawn from the bag holding pins 31, whereby a setting operation is terminated.

Figure 12:
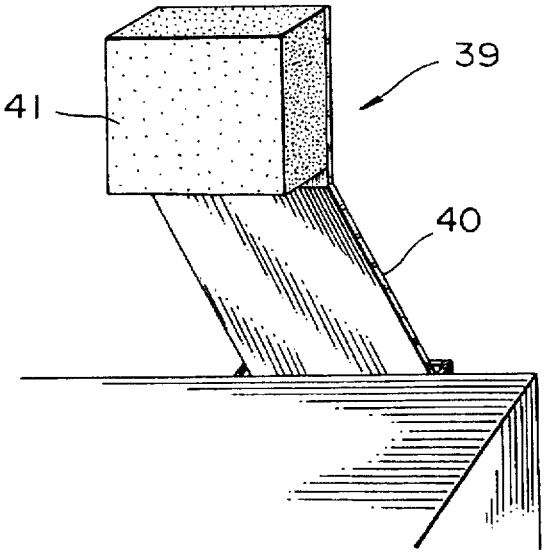
FIG. 12 is a perspective view which shows a adjusting to member and associated components.
Figure 13:
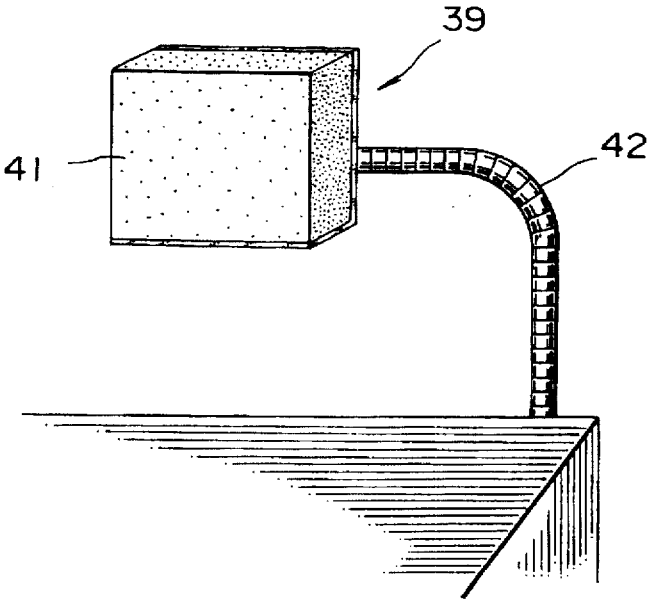
FIG. 13 is another perspective view which shows the correcting member and associated components.

In addition, an adjusting member 39 shown in FIGS. 12 and 13 for adjusting the putting state of each packing bag 7 upon coming in contact with the bottom of the packing bag 7 is disposed on the movement path of the holding frames 6. Since there arises an occasion that the packing bag 7 is put on the holding frame 6 in an incomplete state by operating the putting means in the incomplete state, the adjusting member 39 is arranged on the movement path of the holding frames 6 so that the putting state of each packing bag 7 is adjusted by bringing the adjusting member 39 in contact with the bottom of the packing bag 7 put on the holding frame 6, and moreover, bringing the correcting member 39 in contact with the holding frame 6 via the packing bag 7, whereby the reliable putting state is obtainable.

As shown in FIG. 12 the adjusting member 39 is constructed such that a rubber plate 41 is attached to a plate member 40 at an upper part of the latter so as to adjust the putting state by bringing the packing bag 7 in contact with the rubber plate 41 immediately after the packing bag 7 is put on the holding frame 6. Alternatively, the adjusting member 39 may be constructed as shown in FIG. 13 such that the rubber plate 41 is attached to the foremost end of a flexible pipe 42 having certain flexibility. When the flexible pipe 42 is used, the position, attitude or the like of the rubber plate 41 can be changed in a working site. Thus, adequate working conditions can be settled, and the flexible pipe 42 can adequately cope with the changing of a size of the packing bag 7 or the like.

Next, a guard member 43 for preventing the packing bag 7 from being tilted is arranged between the holding frame 6 and the arm 5. In the case that the packing bag 7 does not straightly fall down but falls down in an inclined state after articles 8 are inserted into the packing bag 7 put on the holding frame 6 and then the packing bag 7 passes through the holding frame 6, the packing bag 7 comes in contact with the guard member 43 to prevent it from being inclined and the falling-down of the packing bag 7 in the downward direction is properly guided by the guard member 43, so that the passing of the packing bag 7 through the holding frame 6 can smoothly be conducted. When the packing bag 7 is inclined and the inserted state of the articles 8 are worsened, there often arises an occasion that aesthetic appearance of the packing bag 7 having a plurality of articles 8 packed therein is deteriorated.

Figure 14:
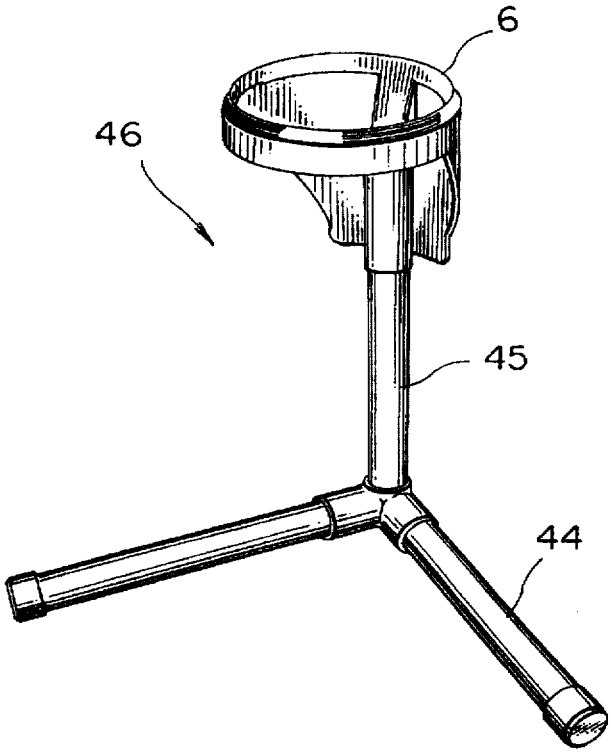
FIG. 14 is a perspective view which shows the case wherein the holding frame is used in an immovable state.

On the other hand, the holding frame 6 can be connected and disconnected to the arm 5. By connecting or disconnecting the holding frame 6 to the arm 5, it becomes possible to exchange the holding frame 6 with another one depending on the kind shape, nature or the like of the articles so that each packing operation can effectively be performed. An assembly as shown in FIG. 14 can be used as a stationary type packing assist instrument 46 by dismounting only the holding frame 6 from the arm 5 and fitting it to a support column 45 standing upright from a stationary base member 44 or the like.

Next, the packing assist apparatus 1 is constructed such that the arm 5 is designed in the L-shaped form and the foremost end part of the arm 5 is oriented in the same direction as the direction of rotation. Thus, the packing bag 7 can reliably be put on the holding frame 6 fitted to the foremost end part of the arm 5, and an inserting operation for the articles 8 as shown in FIG. 4 can effectively be performed.

The packing assist apparatus 1 has three arms 5 around the rotary member 4 in the present embodiment Since the number of the arm 5 is set to three or four, and the arms 5 are adequately arranged in the equally spaced angular relationship the putting of the packing bag 7 on the holding frame 6 and the inserting operation for inserting the articles 8 into the packing bag 7 can successively and effectively be performed. Incidentally, when the number of arms is set to two or less, an efficiency of the packing operation is remarkably degraded, and when the number of arms is set to five or more, the distance between the adjacent arms becomes excessively short and in the case where each arm has a short length, there appears a tendency that the open end of the packing bag put on the holding frame 6 touches the adjacent arm, causing the packing operation to be obstructed.

Next, the packing assist apparatus 1 is constructed such that the holding frame 6 is designed in the form of a circular ring. Thus, the articles 8 are inserted into the central part of the packing bag 7 in the collected state so that they are packed uniformly as viewed from any direction, whereby the packing operation can be performed regardless of the direction of the articles 8.

Figure 15:
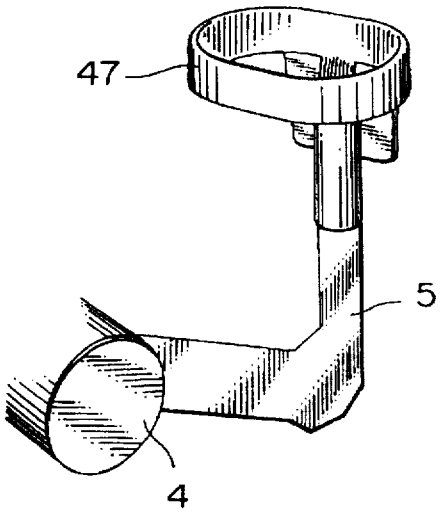
FIG. 15 is a perspective view which shows the holding frame constructed in accordance with a modified embodiment of the present invention.

On the other hand, as shown in FIG. 15, an elliptic shaped holding frame 47 can be employed. In the case where the elliptic shaped holding frame 47 is employed, the articles can be flatly received in the packing bag in a side- by-side relationship without collective receiving them in the central part of the packing bag. This has a merit that received articles received in the packing bag can readily be observed from the outside, and when they are put on a show- case or shelf, they are beautifully observed by a consumer. In such manner, since the packed state can be changed by designing the holding frame in the circular shape or in the elliptic shaped contour, an adequate packing operation can be performed depending on the kind, shape and nature of the articles.

Regardless of the case where the circular shaped holding frame 6 is employed and the case that the elliptic shaped holding frame 47 is employed, articles can smoothly be inserted into the packing bag put on the holding frame and thus the packing operation can effectively be achieved.

Next, the position where the holding frame 6 is fitted to the arm 5 may be changed. Since the fitting position of the holding frame 6 can be changed, it is possible to adequately cope with the kind, shape and nature of the articles. An operator can perform a packing operation with reasonable attitude by changing the fitting position of the holding frame depending on the operator's attitude and his working conditions.

Alternatively, the arm 5 may be designed to expand or contract. When the arm 5 is designed in an expansible and contractible shape, it is possible to change the position of the holding frame 6 corresponding to the length of the articles. In addition, when the position of the holding frame 6 is changed depending on the operator's attitude, he can perform a packing operation without any difficulty.

Additionally, the arm 5 may be connected and disconnected to the rotary member 4. When the arm 5 is connected and disconnected in that way, it is possible to exchange the arm 5 with another one having an adequate shape and size corresponding to the kind and size of the articles. On the other hand, when the arm 5 having the holding frame attached thereto is dismounted from the rotary member 4 and connected to another stationary stand or the like, it can be used as a stationary type packing assist instrument.

Figure 16:
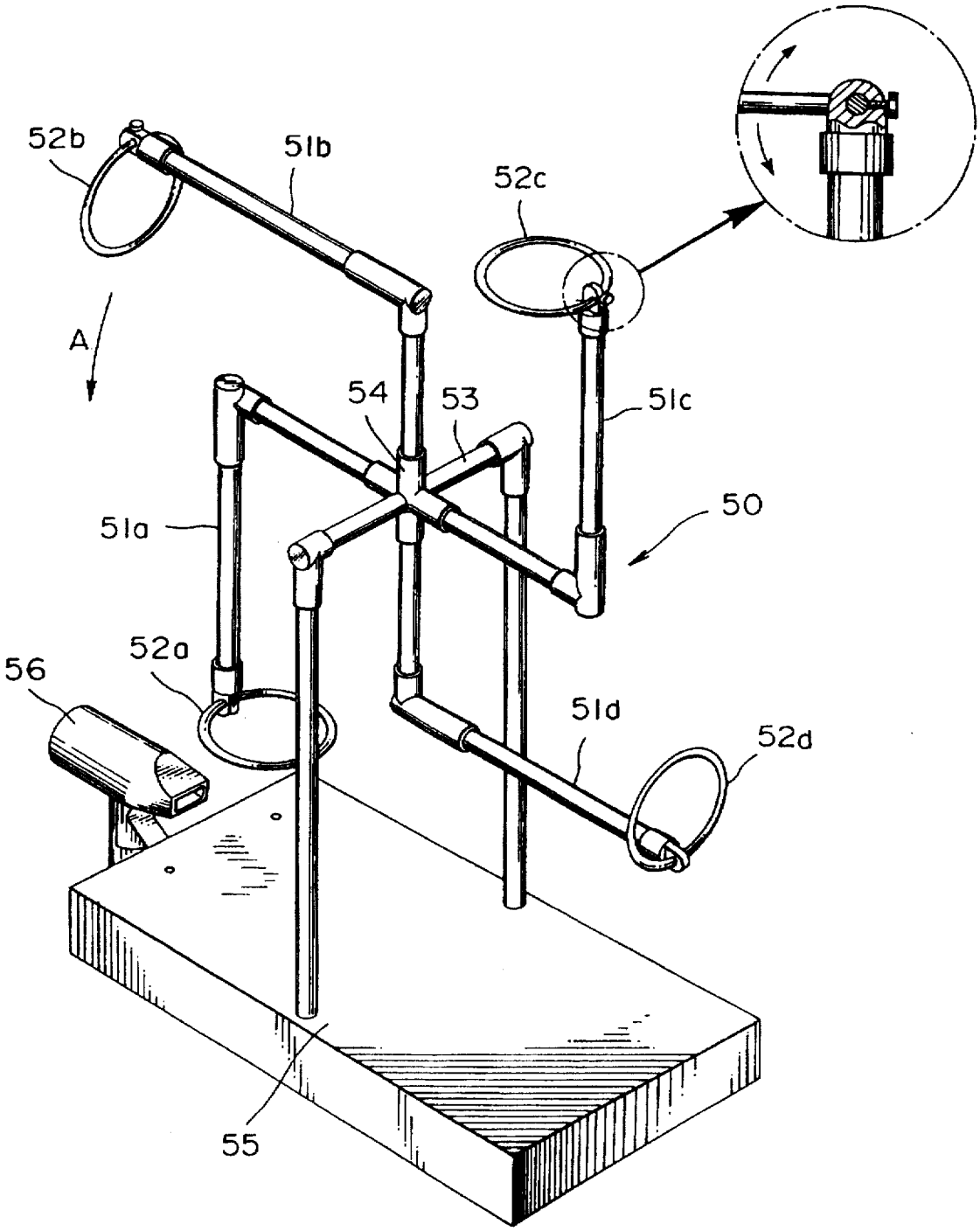
FIG. 16 is a perspective view which shows a packing assist apparatus constructed in accordance with a second embodiment of the present invention.
Figure 17:
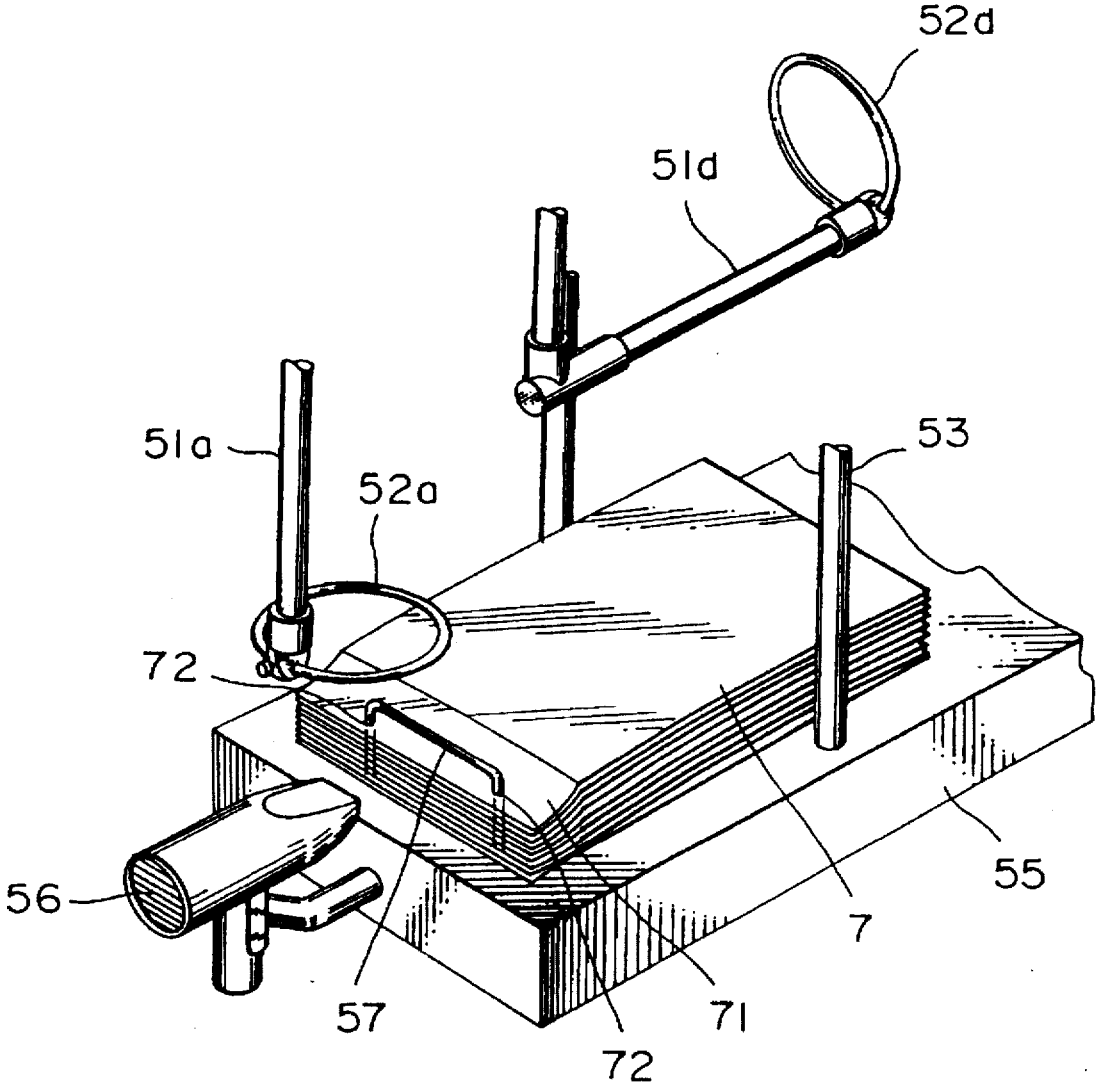
FIG. 17 is a perspective view which shows a fitting state of a packing bag for the packing assist apparatus.
Figure 18A:
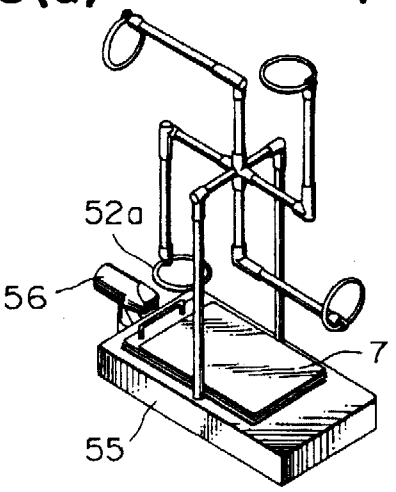
FIG. 18(*a*) to (*f*) show by way of perspective views a procedure of packing by operating the packing assist apparatus shown in FIG. 16.
Figure 18B:
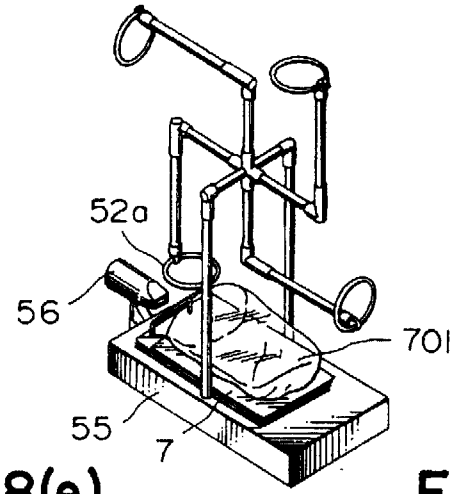
Figure 18C:
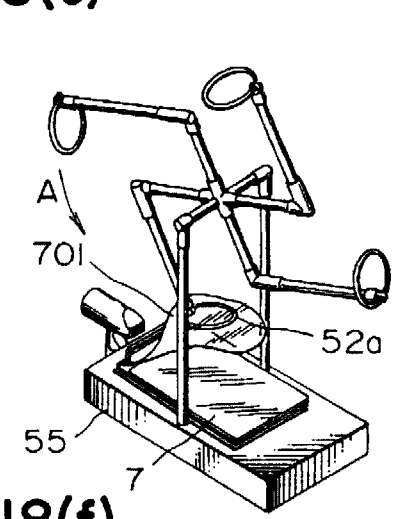
Figure 18D:
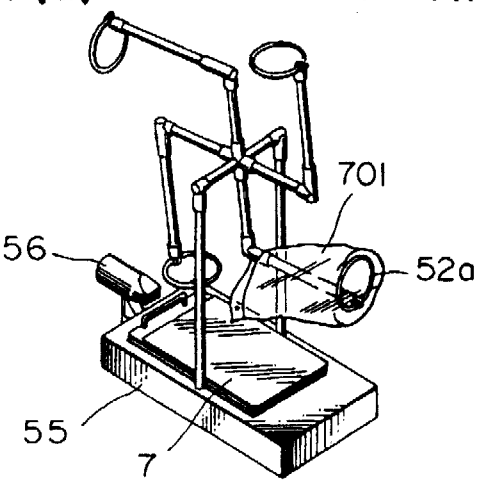
Figure 18E:
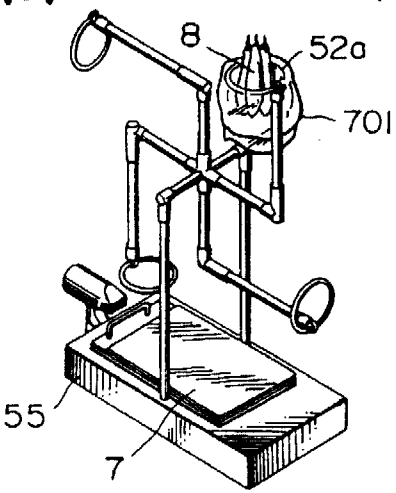
Figure 18F:
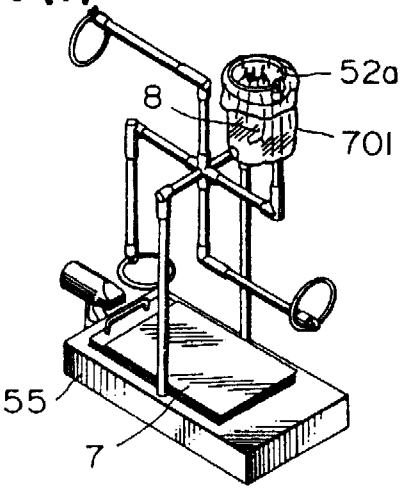

FIG. 16 is a perspective view of a packing assist apparatus 50 constructed in accordance with a second embodiment of the present invention, FIG. 17 is a perspective view which shows how packing bags are placed on the packing assist apparatus shown in FIG. 16, and FIGS. 18(*a*) to 18(*f*) show a process of packing by way of perspective views.

According to this embodiment, the packing assist apparatus 50 is constructed such that four holding frames are attached to four arms wherein each base end is connected to a rotary member so that packing bags are automatically put on the holding frames by utilizing the rotation of the latter. In the case of this embodiment where each arm has a long length compared with a diameter of the holding frame, an efficiency of each packing operation is not degraded even though four arms are connected to the rotary member.

In this embodiment, the packing assist apparatus 50 is composed of four L-shaped arms 51*a* to 51*d*, ring-shaped holding frames 52*a* to 52*d*, a gate type support column 53, a base board 55 with a retainer and a blower 56.

The arms 51*a* to 51*d* are such that each pipe molded of synthetic resin is formed in an L-shaped contour. The holding frames 52*a* to 52*d* are attached to the foremost ends of the arms 51*a* to 51*d* and base ends of the arms 51*a* to 51*d* are crosswise collected and attached to an upper beam of the support column 53 via a connecting member 54 serving as a rotary member so that they are supported in such a manner that they can be rotated only in the A arrow-marked direction via a ratchet mechanism (not shown).

Each of the holding frames 52*a* to 52*d* is made of a stainless steel rod which is formed in a ring-shaped contour, and the holding frames 52*a* to 52*d* are attached to the foremost ends of the arms 51*a* to 51*d* so that they assume a substantially horizontal attitude when their upper parts are upwardly oriented, and moreover, as partially shown on an enlarged scale in FIG. 16, an angle of each of the holding frames 52*a* to 52*d* relative to the arms 51*a* to 51*d* can be adjusted as required. The holding frames 52*a* to 52*d* are dimensioned such that the packing bag 7 can be put on each of the holding frames 52*a* to 52*d* as shown in FIG. 18(*e*) in the same manner as the pattern in the first embodiment.

The support column 53 is molded of synthetic resin and is made in a gate-shaped contour, with its upper beam connected to the base ends of the arms 51*a* to 51*d* via the connecting member 54. The lower end of the support column 53 is fixed to the base board 55.

The base board 55 is prepared in the form of a flat plate so that the whole packing assist apparatus 50 can be supported maintaining stability when it is used, and moreover, a number of packing bags 7 can be placed on the base board 55 in a laminated state as will be described later.

The blower 56 is an air blowing unit for expanding one by one the packing bags 7 placed on the base board 55 in the laminated state. With the blowing port of the blower 56 is oriented toward the upper part of the laminated packing bags 7, the blower 56 is fixed to the one end side of the base board 55.

When packing articles 8, 30 to 50 bags 7 are first laminated in position with correct orientation and placed on the base board 55 while the opening side of each bag 7 is located opposite to the blowing port of the blower 56, and an inverted U-shaped retainer 57 is inserted through two holes 72 formed on a protruded end part 71 located on the opening side of each bag 7, whereby the laminated bags 7 are firmly held on the base board 55.

As shown in FIG. 18(*a*), when one of the first holding frames 52*a* is located between the bag 7 on the base board 55 and the blower 56, a switch(not shown)for the blower 56 is turned on. As the blower 56 is driven, the air blown from the blower 56 is received by an uppermost bag 701 so that it is expanded as shown in FIG. 18(*b*). When the arms 51*a* to 51*d* are rotated as shown in FIG. 18(*c*) while the foregoing state is maintained, the holding frame 52*a* is received in the expanded bag 701, and then, when the arms 51*a* to 51*d* are rotated as shown in FIG. 18(*d*), the holding frame 52*a* abuts against the bottom of the bag 701 so that the bag 701 is pulled slantwise upwardly. As mentioned above, the bag 701 is firmly held on the base board 55 by the retainer 57 but it is torn at the holes 72 as the bag 701 is pulled slantwise upwardly by the rotation of the holding frame 52*a*, causing the projecting end part 71 to be parted away from the retainer 57. Thus, while the bag 701 is put on the holding frame 52*a*, it is raised up together with the holding frame 52*a*.

When several articles 8 are thrust in the holding frame 52*a* together with the bag 701 while the foregoing state is maintained as shown in FIG. 18(*e*), the bottom of the bag 701 is thrust by the articles 8 downwardly of the holding frame 52*a* in the same manner as the first embodiment, whereby as shown in FIG. 18(*f*), the bag main body passes past the holding frame 52*a* together with the articles 8 while turning the bag 701 inside out. When the bag main body passes past the holding frames 52*a*, insertion of the articles 8 into the bag 701 is terminated. Subsequently, the arms 51*a* to 51*d* are rotated in the same manner as mentioned above, the articles are inserted into the bag 7 with the use of the holding frames 52*b* to 52*d*, and then an inserting operation can continuously be performed for inserting the articles 8 into the bag 7 by repeating the foregoing steps.

With the packing assist apparatus 50 constructed in accordance with this embodiment, each bag 7 can automatically be put on the holding frames 52*a* to 52*d* upon expanding of the uppermost bag of the bags 7 placed on the base board 55 in the laminated state while the four arms 51*a* to 51*d* are rotated. Although illustration is herein omitted, ON/OFF of the switch for the blower 56 can automatically be shifted in association with the rotation of the arms 51*a* to 51*d* by disposing on the support column 53 the switch for the blower 56 adapted to be shifted by the rotation of the arms 51*a* to 51*d* and allowing a lead wire to extend between the support column 53 on the base board 55 and the blower 56.

As described above, the packing assist apparatus of the present invention is generally simple in structure and small-sized. Thus, it can easily be employed also by small-scaled facilities and it is optimum that the articles are inserted in the packing bag while it is mounted on a working table or the like. Each of the aforementioned embodiments is described with respect to the articles. However, the packing assist apparatus should not be limited only to the articles but it can be employed for packing fruits, flowers or the like. The size and shape of each holding frame can arbitrarily be designed depending not only on the kind and number of articles to be packed but also on a size of the packing bag.

According to the present invention, the following advantageous effects are provided.

(1) With the packing assist apparatus of the present invention, while the rotary member is disposed on the support column standing upright from the base board, a packing operation can be performed while holding frames are rotated, by attaching arms to the rotary member and then fitting packing bag holding frames to the arms. Namely, since putting of the packing bag on the holding frame and inserting of the articles into the packing bag can continuously be achieved, an efficiency of each packing operation is substantially improved.

In this case, since the articles can be inserted in the packing bag from the bottom side which has been previously turned upside down when the packing bag is put on the holding frame and the articles are thrust into the packing frame while turning the packing bag inside out, ever the articles each having a smooth surface and readily coming in tight contact with the packing bag film are smoothly inserted into the packing bag, whereby each packing operation can be achieved with an excellent efficiency.

(2) Above since the holding frame is immovably held at a predetermined position by allowing the packing assist apparatus to be equipped with a click mechanism for locking the rotation of the rotary member at every predetermined angle, an inserting operation for inserting the articles into the packing bag can easily and effectively be achieved by employing the structure for holding the holding frame having the packing bag put thereon at the predetermined position, e.g., a horizontal position.

When the packing assist apparatus has a double structure that a stationary shaft is composed of a spline shaft and a boss adapted to be fitted to the spline shaft, it is possible to change the holding position of the holding frame to a desired position by the function of the click mechanism.

(3) With respect to the packing assist apparatus as described in the above paragraph (1), by employing the structure that a putting means for putting the packing bag on the holding frame is disposed on the movement path of the holding frame so that the packing bag is automatically put on the holding frame by rotation of the holding frame, each putting operation can easily and reliably be achieved. In addition, by providing the packing assist apparatus with a receiving portion for receiving the packing bags means and a bag holding means for holding the open end of the packing bag in the opened state as the putting means, the putting of the packing bag on the holding frame can automatically be conducted as the holding frame is rotated.

In addition, by disposing a blown air quantity adjusting means on a blower an adequate quantity of blown air can be effectively supplied depending on a size of the packing bag and the packing operation.

Additionally, by designing a packing bag holding surface of the packing bag receiving portion in the form of a concave surface, the open end of the packing bag is easily opened when air is blown toward the open end of the packing bag, and there does not arise a malfunction that the expanded bag is deviated from its correct position, and thus it can be held in a stable state.

By disposing a weight for retaining the projecting end of the packing bag placed on the packing bag holding surface, only an uppermost bag can be expanded when air is blown toward the open end of the packing bag, and moreover, it can be prevented that an expanded packing bag held in the waiting state is disconnected from the bag holding pins by the power of the blown air and flies away therefrom. Therefore, the putting of the packing bag on the holding frame can be achieved one by one without fail.

In this case, by designing an edge portion of the weight coming in contact with the projecting end of the bag in a form of a comb shape contour, the packing bag can reliably be held, and disconnection of each packing bag is very smoothly achieved.

Further, by disposing a projection downward of the weight and fitting the projection in a recess, it can be prevented that the weight is deviated or dislocated when the packing bag is disconnected from the receiving portion. Since the projection of the weight sinks in the recess and the whole weight is increasingly lowered as the packing operation proceeds, the protruded end of a uppermost packing bag can be normally retained by the weight without fail.

On the other hand, by forming a projecting part or a stepped part on the packing bag holding surface, an intensity of pressure caused by the dead weight of the packing bags placed thereon is distributed with the result that an intensity of pressure effective in the vertical downward direction is decreased, and thus, preventing films of each packing bag from coming into tight contact with each other.

Moreover, by disposing an adjusting member on the movement path of the holding frame, the packing bag put on the holding frame comes in contact with the adjusting member, causing the putting state of the packing bag to be adjusted. Thus, a reliable putting state can be obtained.

(4) The packing bag holding frame is contoured such that a lower outer peripheral surface extending in parallel with the center axis of the packing bag holding frame and an inclined surface extending in continuation from the lower outer peripheral surface are formed on the outer peripheral surface of the packing bag holding frame, a curved convex surface is formed on the inner peripheral surface of the same, and a cavity is formed below the curved convex surface. With such formation, not only an operation for putting the packing bag on the holding frame can easily be performed but also an operation for reversing the packing bag can very smoothly be performed during the packing operation. Further, slippage between the holding frame and the packing bag is excellently facilitated, whereby an efficiency of the packing operation is substantially improved.

In addition, when an operation of reversing the packing bag and a slipping operation are smoothly performed by forming the vertical sectional surface of the holding frame in a predetermined vertically elongated shape, an efficiency of the packing operation is substantially improved.

Additionally, when the packing state is changed by designing the holding frame in a circular or elliptic contour, an adequate packing operation can be performed depending on the kind, shape and nature of the articles.

(5) By disposing a guard member between the holding frame and the support column for preventing the packing bag from being inclined, the packing bag put on the holding frame can smoothly pass through the holding frame, and aesthetic appearance of the packing bag after completion of a packing operation is not deteriorated due to the worsening of the inserted state of articles caused by inclination of the packing bag.

(6) By connecting and disconnecting the holding frame to the arm, it is possible to exchange the holding frame with another one depending on the kind, shape and nature of articles, whereby a packing operation can effectively be performed. In addition, by dismounting only the holding frame and then fitting to the support column standing upright from the stationary stand, the holding frame can be used as a simple stationary type packing assist instrument.

(7) When disposing three arms around the periphery of the rotary member in an equally spaced relationship, the distance between the adjacent arms becomes adequate so that the putting of the packing bag on the holding frame and an inserting operation for inserting articles into the packing bag can successively be performed at excellent efficiency.

In addition, by designing the arm so as to be expansible and contractible, it is possible to change the position of the holding frame depending on the length of articles, and since the position of the holding frame can be changed depending on an operator, he can perform a packing operation without any difficulty.

Additionally, by connecting and disconnecting the arm to the rotary member, it is possible to exchange the arm with another one having adequate shape and size corresponding to the kind and size of articles. On the other hand, by disengaging the arm having the holding frame attached thereto from the rotary member and then fitting to another stationary base or the like, the arm can be used as a simple stationary type packing assist instrument.

Further, by making the position of the fitting of the holding frame to the arm changeable, the arm can adequately cope with the kind, shape and nature of various articles. Furthermore, by changing the position of the fitting of the holding frame depending on an operator's attitude and his working conditions, he can perform a packing operation without any difficult.

While the present invention has been described above with respect to preferred embodiments thereof, it should be noted that the present invention should not be limited only to these embodiments but various changes or modifications may be made without departure from the scope of the present invention as defined in the appended claims.

What is claimed is:

1. A packing assist apparatus comprising:

a support column supported in an upright position and projecting from a base;

a rotary member operatively connected to said support column for rotation relative thereto in a substantially vertical plane;

a plurality of arms, each arm including a based end side fitted to said rotary member; and a plurality of packing bag holding frames each having a through hole for allowing articles to be packed and a packing bag to pass therethrough, each of said packing bag holding frames being contoured such that the packing bag can be placed thereon with the bottom of said packing bag being oriented to one open end of said through hole, and said packing bag holding frames being fitted to the foremost ends of said arms.

2. The packing assist apparatus according to claim 1, and further including a click mechanism disposed between said rotary member and a stationary shaft on the support column wherein said rotary member may be stopped at a predetermined angle of rotation of said rotary member.

3. The packing assist apparatus according to claim 2, wherein said click mechanism includes recesses formed on an outer peripheral surface of said stationary shaft and a ball bearing biased to protrude from an inner peripheral surface of said rotary member so as to be fitted into said recesses at said predetermined angle of rotation of said rotary member.

4. The packing assist apparatus according to claim 3, wherein disengaged guide surfaces are formed adjacent to said recesses on the outer peripheral surface of said stationary shaft so that said balls pass past disengaging guide surfaces when the are disengaged from said recesses.

5. The packing assist apparatus according to claim 4, wherein said stationary shaft comprises a spline shaft and a boss having a hole to be fitted onto said spline shaft.

6. The packing assist apparatus according to claim 1, and further including a supplying means for putting the packing bag on said packing bag holding frame when said arms are rotated, said supplying means being disposed on the movement path of said packing bag holding frames.

7. The packing assist apparatus according to claim 6, wherein said supplying means includes a receiving portion for holding said packing bag and a bag holding means for holding an open end of said packing bag in an opened state, and each of said arms is designed in an L-shaped contour so as to allow each packing bag holding frame to enter said packing bag through the open end when said arms are rotated.

8. The packing assist apparatus according to claim 7, wherein said bag holding means is composed of a retainer for retaining a protruding end on an open end side of said packing bag placed on said receiving portion and a blower for blowing air toward the open end of said packing bag.

9. The packing assist apparatus according to claim 7, wherein a receiving portion is disposed on the base board from which said support column stands upright.

10. The packing assist apparatus according to claim 7, wherein said blower includes a blown air quantity adjusting means for changing a quantity of air blown from said blower.

11. The packing assist apparatus according to claim 7, wherein a packing bag holding surface of said receiving portion is designed in the form of a concave surface.

12. The packing assist apparatus according to claim 8, and further including a weight for retaining the protruding end on the open end side of said packing bag placed on the packing bag holding surface of said receiving portion.

13. The packing assist apparatus according to claim 12, wherein an edge part of said weight adapted to come in contact with the protruding end on the open end of said packing bag is designed in a comb-shaped contour.

14. The packing assist apparatus according to claim 12, wherein said weight includes a protrusion at the lower part thereof which is fitted in a recess formed on the packing bag holding surface of said receiving portion.

15. The packing assist apparatus according to claim 7, wherein a protrusion or a stepped part is disposed on the packing bag holding surface of said receiving portion.

16. The packing assist apparatus according to claim 6, wherein an adjusting member is adapted to come in contact with the bottom of the packing bag put on said packing bag holding frame for adjusting a putting state of the packing bag relative to said packing bag holding frame and is disposed on a movement path of said packing bag holding frames.

17. The packing assist apparatus according to claim 1, wherein each of said packing bag holding frames is contoured such that a lower outer peripheral surface extends in parallel with the direction of extension of an axis of the packing bag holding frame, an upper outer peripheral surface extending in continuation from said lower outer peripheral surface is designed in a form of an inclined surface slantwise extending toward said axis, and an upper inner peripheral surface is designed in a form of a curved convex surface smoothly extending from an upper edge of said inclined surface in the downward direction.

18. The packing assist apparatus according to claim 17, wherein an inner peripheral surface of the packing bag holding frame extending said curved convex surface to the lower end of the packing bag holding frame is recessed in such a direction that an inner diameter of the packing bag holding frame is increased.

19. The packing assist apparatus according to claim 17, wherein an inclined angle of said inclined surface relative to the axial direction of the packing bag holding frame is set to the range of 30 to 45 degrees, and the position of a boundary between said inclined surface and said lower outer peripheral surface and the position of a lower edge of said curved convex surface are located higher than about a half of the height from the lower end to the upper end of the packing bag holding frame.

20. The packing assist apparatus according to claim 1, wherein each of said packing bag holding frames assumes a circular shaped contour.

21. The packing assist apparatus according to claim 1, wherein a guard member is disposed between the packing bag holding frame and the arm for preventing the packing bag put on the packing bag holding frame from being inclined relative to the axial direction of the packing bag holding frame.

22. The packing assist apparatus according to claim 1, wherein each of said arms is designed to be expansible and contractible.

23. The packing assist apparatus according to claim 1, wherein each of said arms is connectable to and disconnectable from said rotary member.

24. The packing assist apparatus according to claim 1, wherein the packing bag holding frame is connectable to or disconnectable from the arm.

25. The packing assist apparatus according to claim 1, wherein the position where the packing bag holding frame is connected to the arm can be changed.

26. The packing assist apparatus according to claim 1, wherein a plurality of arms are connected to said rotary member in an equally spaced angular relationship.

27. The packing assist apparatus according to claim 1, wherein three arms are connected to said rotary member.

28. The packing assist apparatus according to claim 1, wherein each of said packing bag holding frames assumes an elliptic shaped contour.

* * * * *